US007247128B2

(12) United States Patent
Oga

(10) Patent No.: US 7,247,128 B2
(45) Date of Patent: Jul. 24, 2007

(54) EXERCISE ASSISTING MACHINE

(75) Inventor: Takayuki Oga, Tokyo (JP)

(73) Assignee: Oga Co., Ltd., Tokyo (JP)

( * ) Notice: Subject to any disclaimer, the term of this patent is extended or adjusted under 35 U.S.C. 154(b) by 0 days.

(21) Appl. No.: 10/509,776

(22) PCT Filed: Nov. 6, 2002

(86) PCT No.: PCT/JP02/11574

§ 371 (c)(1),
(2), (4) Date: Sep. 27, 2004

(87) PCT Pub. No.: WO03/082410

PCT Pub. Date: Oct. 9, 2003

(65) Prior Publication Data

US 2005/0227826 A1 Oct. 13, 2005

(30) Foreign Application Priority Data

Apr. 3, 2002 (JP) ..... 2002-101197

(51) Int. Cl.

| | |
|---|---|
| ***A63B 23/00*** | (2006.01) |
| ***A61G 5/14*** | (2006.01) |
| *A63B 21/068* | (2006.01) |
| *A63B 21/08* | (2006.01) |

(52) U.S. Cl. ..... 482/51; 482/72; 482/96; 482/142; 297/DIG. 10

(58) Field of Classification Search ..... 482/121, 482/123, 51, 71, 72, 79, 92, 93, 95–97, 101, 482/135, 142, 145; 297/DIG. 10, 344.1, 297/344.12, 338; 601/24, 33–35; 434/253; 128/845

See application file for complete search history.

(56) References Cited

U.S. PATENT DOCUMENTS

| | | | | |
|---|---|---|---|---|
| 3,259,427 | A * | 7/1966 | Wiest | 297/183.9 |
| 3,807,728 | A * | 4/1974 | Chillier | 482/101 |
| 4,456,086 | A * | 6/1984 | Wier et al. | 180/11 |
| 4,569,556 | A * | 2/1986 | Pillot | 297/316 |
| 4,598,944 | A * | 7/1986 | Meyer et al. | 297/183.9 |
| 4,666,151 | A * | 5/1987 | Chillier | 482/135 |
| 4,884,841 | A * | 12/1989 | Holley | 297/331 |
| 4,929,022 | A * | 5/1990 | Geraci | 297/313 |

(Continued)

FOREIGN PATENT DOCUMENTS

| | | | |
|---|---|---|---|
| JP | 4-15957 | | 10/1992 |
| JP | 09262191 | A * | 10/1997 |
| JP | 10-005279 | | 1/1998 |
| JP | 10-5279 | A * | 1/1998 |
| JP | 10005279 | A * | 1/1998 |
| JP | 2000-070405 | | 3/2000 |
| WO | WO 8500006 | A1 * | 1/1985 |

*Primary Examiner*—Cary E. O'Connor
*Assistant Examiner*—Victor K. Hwang
(74) *Attorney, Agent, or Firm*—Leighton K. Chong

(57) ABSTRACT

An exercise assisting instrument assists the user's knee-bending exercise, and lightens a burden and maintains safety of the user. It has a base 10, supporting columns 20, lifting mechanisms 30 consisting of lifting arms, lever arms 40, and a chair 50. A three-member linkage system is formed by the supporting columns 20 and the lifting mechanisms 30, so that the chair 50 may move upward and downward. Further, it is equipped with an upward movement assisting device 33, which provides a force in the raising direction to the hinge point 30*a* of the lifting arms, so that stand-up movement of the user is assisted and lightening the user's burden is possible. Moreover, a locking device 11 and a stopper 13 are equipped, so the user's safety may be improved.

18 Claims, 19 Drawing Sheets

U.S. PATENT DOCUMENTS 5,201,694 A * 4/1993 Zappel ..... 482/133
5,265,689 A * 11/1993 Kauffmann ..... 180/65.5
5,334,120 A * 8/1994 Rasmussen ..... 482/97
5,549,529 A * 8/1996 Rasmussen ..... 482/96
5,626,389 A * 5/1997 Logan, Jr. ..... 297/250.1
5,667,460 A * 9/1997 Smith ..... 482/8
5,711,749 A * 1/1998 Miller ..... 482/135
5,810,698 A * 9/1998 Hullett et al. ..... 482/96
5,853,015 A * 12/1998 Evans ..... 135/67
5,964,684 A * 10/1999 Sokol ..... 482/96
6,015,369 A * 1/2000 Rasmussen ..... 482/96
6,053,519 A * 4/2000 Poindexter et al. ..... 280/250.1
6,186,929 B1 * 2/2001 Endelman et al. ..... 482/121
6,213,554 B1 * 4/2001 Marcoux et al. ..... 297/330
6,632,160 B2 * 10/2003 LaFond et al. ..... 482/95
6,652,429 B2 * 11/2003 Bushnell ..... 482/128
6,976,698 B2 * 12/2005 Kuiken ..... 280/647

* cited by examiner (a)

(b)

EXERCISE ASSISTING MACHINE

BACKGROUND OF THE INVENTION

1. Field of the Invention

The present invention relates to an exercise assisting instrument and more specifically to an exercise assisting instrument that fits to use assisting knee-bending exercise of legs and knees or exercise of waist and arms.

2. Description of Related Art

In Japan, an aging ratio of population is rapidly increasing, and currently one person per six people is over 65 years old. Generally many of elder people have some kinds of illness, especially rate of elder people suffering from arthritis is high. Further, the more the age is advanced, the worse legs and knees or waist and arms are and become disabled in every day life gradually. And they stop exercising because of disability, and the state of the malfunction progresses forming a vicious circle. To solve the problem, a variety of exercise assisting instrument have been developed conventionally.

Japanese Patent Kokai No. 2000-70405 discloses one of exercise instrument for leg exercise (refer to Japanese Patent Kokai No. 1). The invention defined in Japanese Patent Kokai No. 1 is an exercise instrument that makes a user able to exercise legs as effectively as if the user does walking exercise without putting his/her weight on his/her legs and waist. The user lies on his/her back on a frame, the angle of which can be changed, hangs both legs on a leg-hanging-part slung by means of pulley(s), and moves legs hung on the leg-hanging-part up and down while his/her body is kept lied down, so he/she may exercise his/her legs without putting his/her weight on his/her legs.

Moreover, Japanese Patent Kokai No. Hei 10-5279 discloses an invention of a standing up assisting instrument (refer to Japanese Patent Kokai No. 2). The invention defined in Japanese Patent Kokai No. 2 is the invention of a standing up assisting instrument used in rehabilitation for a handicapped person who cannot stand up, and it helps a user stand up by oneself safely. The user fixes his/her lower body by buttocks supporting part and longitudinal ditch formed mat into which his/her knees are fit, and becomes able to stand upright by oneself, by supporting upper body by cylindrical mat on which arms lean. And, in this state, the user bends his/her knees, while he/she winds up traction line by backward traction device set on the standing up assisting instrument, and at the same time by up and down movement of the buttocks supporting part operating together with expansion and contraction of lifting and rotating arms connected to the traction line.

However, the exercise instrument of the invention defined in Patent Publication No. 1 does not function if the user cannot raise his/her legs by oneself so the users are limited to those who can raise their legs by themselves. Further, the user lies on his/her back and exercises only his/her legs so there exists a problem in which he/she may exercise only his/her legs and cannot exercise the whole body.

Moreover, in the invention defined in Patent Publication No. 2, the user set in designated position can do knee-bending exercise automatically by turning on an electric machine with the lifting and rotating arms and the electric machine. But, the user cannot exercise by his/her intention, so the user cannot have an intention of training by oneself and cannot have fun. Further, there are problems in which using electric machine causes a big noise and vibrations, and the user may have anxiety about having malfunction of the machine.

Therefore, the present invention solves the problems mentioned above, and aims to provide an exercise assisting instrument which a user may easily and safely do knee-bending exercise corresponding to his/her respective physical strength. To put it concretely, the invention aims to provide the exercise assisting instrument that may lighten burdens imposed on the user's legs, knees and so on while the user can do the knee-bending exercise repeatedly from any position corresponding to the user's respective physical strength. Furthermore, even at a time the user's physical strength goes to the limit and suddenly his/her knees and waist becomes unsteady and the user cannot help squatting down, to prevent bone-breaking accident, the present invention aims to provide the exercise assisting instrument having a chair which moves upward and downward always in a state coming into contact with his/her buttocks so that the user may sit down on the chair from any position while he/she does the knee-bending exercise. The user may sit down on the chair as he/she lean on it and may go down to the lowest point slowly and safely with aid of upward force affecting the chair. Further, the present invention aims to provide the exercise assisting instrument of simple structure and low production cost because no need of power source from outside.

SUMMARY OF THE INVENTION

To solve the problems mentioned above, the invention is an exercise assisting instrument for assisting knee-bending exercise being characterized in that, a lifting device always positions a chair for supporting a user's body near buttocks of the user, which moves upward and downward together with the knee-bending exercise, whereby the user doing the knee-bending exercise may sit at the chair any time, accordingly the user may do the knee-bending exercise safely.

To solve the problems mentioned above, the invention is the exercise assisting instrument being characterized in that, said lifting device raises the chair in conjunction with pulling movement of user's arms when a user stands up with pulling user's arms.

To solve the problems mentioned above, the invention is the exercise assisting instrument being characterized in that, said lifting device comprises a base; a pair of supporting columns formed on the base; a pair of lifting mechanisms having lifting arms connected to each other at first hinge points, one ends of lifting mechanisms being rotationally connected to said supporting columns and other ends thereof moving upward and downward along said supporting columns, and said one ends serving as second hinge points; a pair of lever arms having handle-parts at their ends for the user to grip, said lever arms being rotationally connected to the supporting columns at third hinge points, around which they swing upward and downward as seesaws; a stopper for abutting the chair to stop when the chair moves down and reaches to the lowest point; an upward movement assisting device for urging an assisting force in a direction that the other ends of the lifting mechanisms move upward; and, a connecting member for connecting the first hinge points of the lifting arms to control the movement of said paired lever arms, wherein said lifting device partially assists standing-up movement of the user and lightens a burden of the knee-bending exercise when the user stands up and pulls said handle-parts of the lever arms upward with gripping said handle-parts.

To solve the problems mentioned above, the invention is the exercise assisting instrument being characterized in that, said lever arms have length adjusting devices so the user may adjust the length thereof corresponding to user's body size.

To solve the problems mentioned above, the invention is the exercise assisting instrument being characterized in that said upward movement assisting device is made of an elastic member which is connected between said stopper and said connecting member.

To solve the problems mentioned above, the invention is the exercise assisting instrument being characterized in that, said lifting device comprises a base; a pair of supporting columns formed on the base; a pair of lifting mechanisms having lifting arms connected to each other at first hinge points, one ends of lifting mechanisms being rotationally connected to said supporting columns and other ends thereof moving upward and downward along said supporting columns, and said one ends serving as second hinge points; a pair of lever arms having handle-parts at their ends &r the user to grip; a connecting member for connecting the first hinge points of the paired lifting arms to control the movement of said paired lever arms; a lifting linkage having a linkage system for moving said moving ends of said lifting mechanisms upward and downward in conjunction with the movements of said lever arms; a lifting base fixed to said moving ends of said lifting mechanisms, said lifting base moving upward and downward together with the upward-downward movement of said moving ends and having support means for supporting said lever arms to move backward and forward; and, an upward movement assisting device for urging an assisting force in a direction that said moving ends of the lifting mechanism moves upward, wherein said lifting device partially assists standing-up movement of the user and lightens a burden of the knee-bending exercise when the user stands up and pulls said lever arms upward with gripping said handle-parts.

To solve the problems mentioned above, the invention is the exercise assisting instrument being characterized in that, said lever arms have length adjusting devices so that the user may adjust the length thereof corresponding to user's body size.

To solve the problems mentioned above, the invention is the exercise assisting instrument being characterized in that, said lifting device comprises a base; a pair of supporting columns formed on the base; a pair lifting mechanisms having lifting arms connected to each other at first hinge points, one ends of lifting mechanisms being rotationally connected to said supporting columns and other ends thereof moving upward and downward along said supporting columns, and said one ends serving as second hinge points; a pair of lever arms which move upward and downward in conjunction with the upward-downward movement of said moving ends; a connecting member for connecting the first hinge points of the paired lifting arms to control the movement of said paired lever arms; a pair of wire members, each having an end which is used as a pulling end part pulled by the user and an other end which is connected at the first hinge point of said lifting arms so that the moving ends of said lifting arms may be moved upward by pulling said pulling end parts; and, an upward movement assisting device for urging an assisting force in a direction that said lifting mechanism moves upward, wherein said lifting device partially assists standing-up movement of the user and lightens a burden of the knee-bending exercise when the user stands up and pulls said lever arms upward with gripping said handle-parts.

To solve the problems mentioned above, the invention is the exercise assisting instrument being characterized in that, said lifting rums have winding devices for winding said wire members at the first hinge points.

To solve the problems mentioned above, the invention is the exercise assisting instrument being characterized in that, said lever arms have an angle adjusting device so that the user may adjust the angle of said lever arms corresponding to user's body size.

To solve the problems mentioned above, the invention is the exercise assisting instrument being characterized in that, said upward movement assisting device is made of an elastic member, which is connected between an upper end of said supporting column and the first hinge point of said lifting arms.

To solve the problems mentioned above, the invention is the exercise assisting instrument being characterized in that, said chair moves upward and downward in conjunction with the upward-downward movement of the moving ends of said lifting arms, wherein said exercise assisting instrument further includes an upward movement stopper to stop said chair at a designated position of height.

To solve the problems mentioned above, the invention is the exercise assisting instrument being characterized in that, said chair has an adjusting device for moving the chair backward and forward so that the position of the chair may be adjusted to a suitable position to the user.

To solve the problems mentioned above, the invention is the exercise assisting instrument being characterized in that, said chair has a structure able to tilt forward so that the user may easily stand up when some part of the user's body touches said chair to tilt forward.

To solve the problems mentioned above, the invention is the exercise assisting instrument being characterized in that, said stopper is a column member established under said chair and supports said chair at the upper part of said column member when said chair moves downward.

To solve the problems mentioned above, the invention is the exercise assisting instrument being characterized in that, said exercise assisting instrument further includes, an assisting force adjusting device that may even the assisting forces of said upward movement assisting devices and also may adjust the force thereby the assisting force being adjusted according to the user's condition.

To solve the problems mentioned above, the invention is the exercise assisting instrument being characterized in that, said exercise assisting instrument further includes a counting a number of knee-bending exercises of the user.

To solve the problems mentioned above, the invention is the exercise assisting instrument being characterized in that, said base has slip stoppers to prevent slipping so that the user does not slip.

THE BEST MODE OF THE INVENTION

Below, embodiments of an exercise assisting instrument of the present invention are explained with reference to the drawings.

Figure 1:
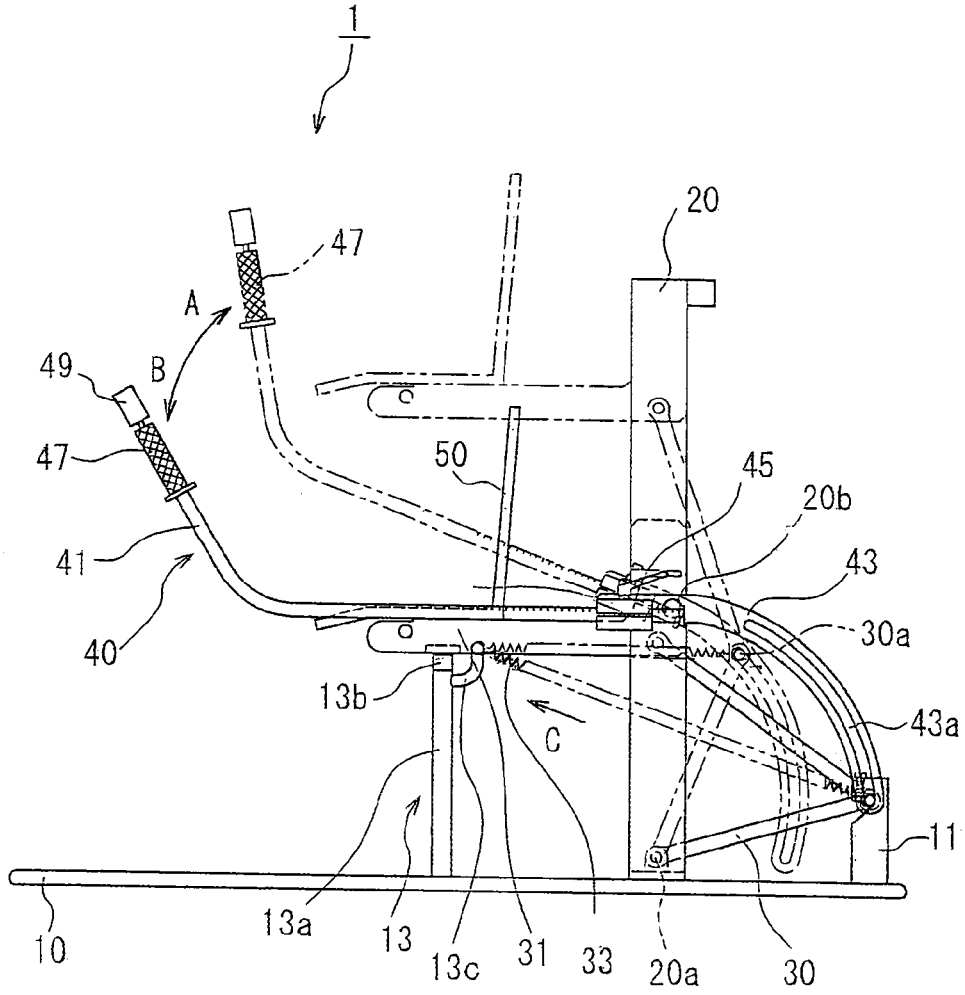
FIG. 1 is a side view showing an exercise assisting instrument 1 of the first embodiment according to the present invention.

FIG. 1 is a first embodiment according to the exercise assisting instrument of the present invention.

An exercise assisting instrument 1 of the present invention comprises a base 10, a pair of supporting columns 20, a pair of lifting mechanism 30, a pair of lever arms 40, a lifting member and a chair 50 as shown in FIG. 1.

Figure 2:
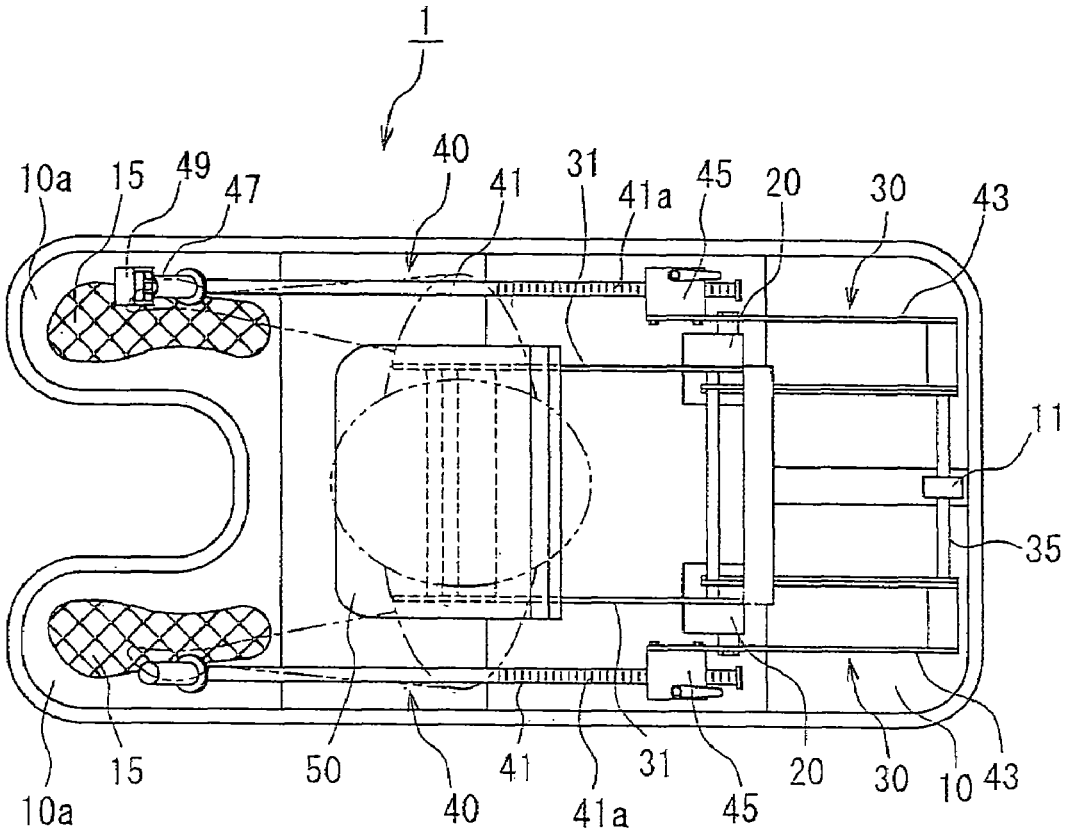
FIG. 2 is a plan view showing the exercise assisting instrument 1 of the first embodiment according to the present invention.

To the base 10, as shown in FIGS. 1 and 2, a locking device 11 for locking the lever arms 40, a stopper 13 for stopping the chair 50 at the lowest point, a pair of slip stoppers 15 to prevent slipping when the user does knee-bending exercise, and a pair of the supporting columns 20 to support the chair 50 to allow it to move upward and downward are assembled.

The base 10 is metallic, and the center of the front part thereof is constricted.

Figure 3:
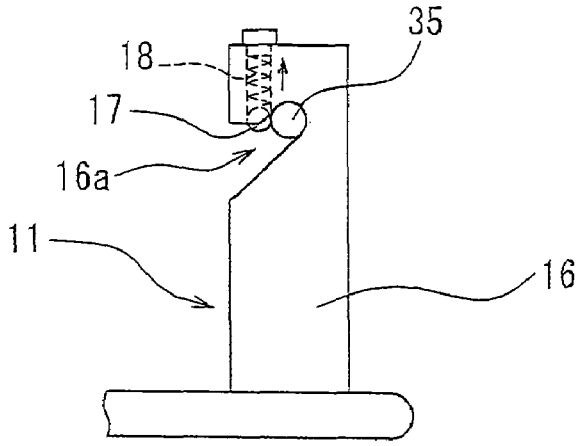
FIG. 3 is a side view showing a lock device.

The locking device 11, as shown in FIG. 3, comprises a locking device body 16, a locking ball 17, and a spring 18. The locking device 11 is positioned almost in the center of the base 10 in its wide direction and at back side of its lengthwise direction. In the locking device 11, a connecting member 35 fits in a cut part 16*a* of the locking device body 16 at the time when the lever arms 40 moves downward and reaches the lowest point. The connecting member 35 and the lever arms 40 move in connection with each other. At this time, the connecting member 35 overcomes pushing force of the spring 18 and pushes the locking ball 17 up to fit into the cut part 16*a*. After this, the connecting member 35 is locked by the pushing force of the locking ball 17.

Conversely, if the lever arms 40 are pulled up forward toward the user with a force greater than the pushing force of the spring 18, the connecting member 35 pushes up the locking ball 17, gets out of the cut part 16*a* of the locking device body 16 from the locked state, and unlocked.

The stopper 13 is a metallic bar material, and, as shown in FIG. 1, comprises a stopper body 13*a* and a buffer rubber 13*b*. It is positioned almost in the center of the base 10 in wide direction and under the chair 50. The stopper 13 supports the chair 50 at its upper end of the stopper 13 when the chair 50 moves down and reaches to the lowest point. In this embodiment, the buffer rubber 13*b* is used to buffer shock of collision with the chair 50, but any buffer members that can absorb the shock as a whole such as a sponge and a spring may be substituted.

The slip stoppers 15 are made of rubber and cut ditch at the surface to make the slip resistance performance more effective. Each slip stopper 15 is positioned evenly on each projecting part 10*a* formed by the constricted part of the base 10 so that the position of the user's foot fits in, respectively. Or, the same effect may be achieved by forming ditch directly on the projecting part 10*a*, even though in the embodiment shown the ditch cut rubber at the surface is used.

Figure 4:
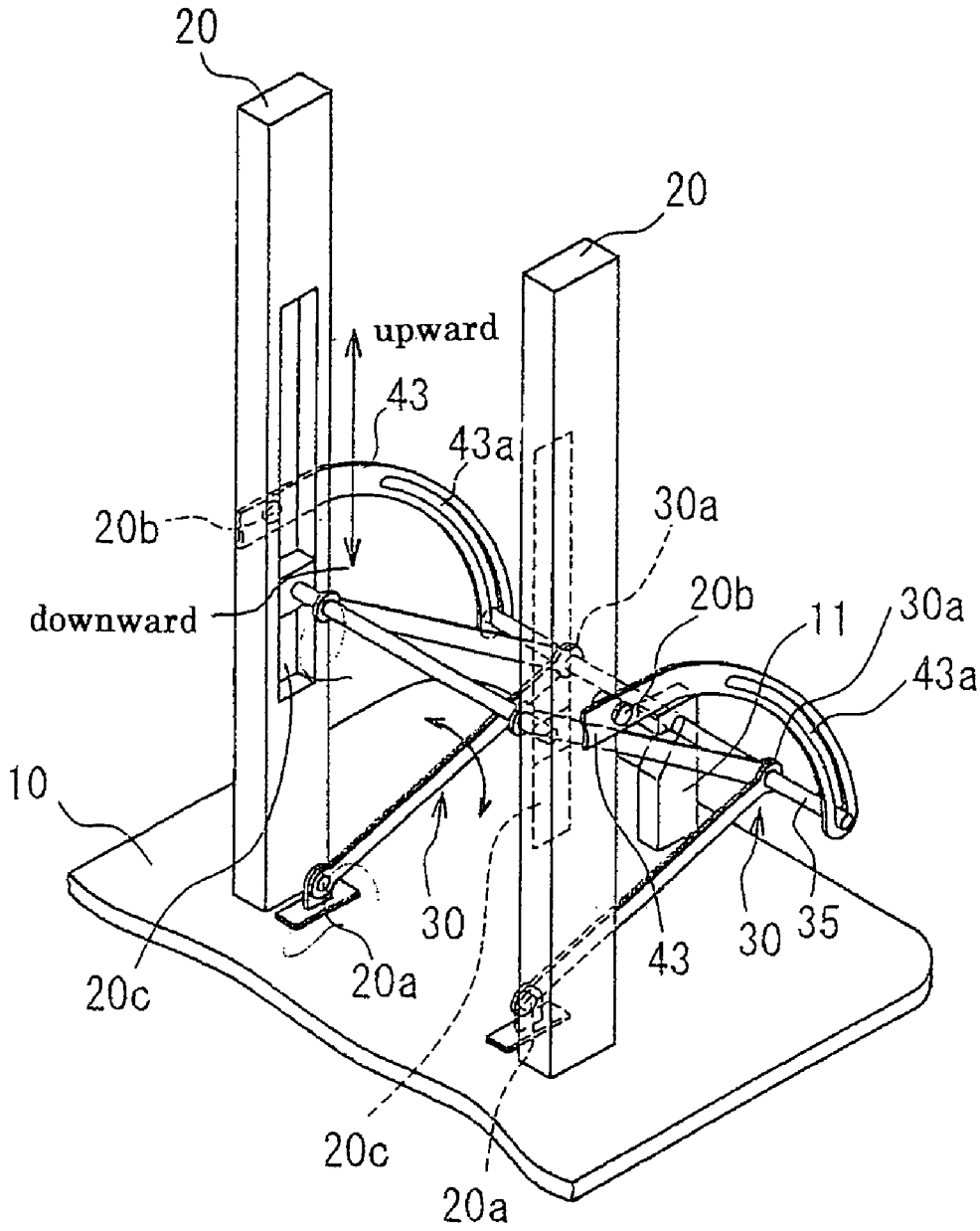
FIG. 4 is a perspective view showing supporting columns.

The supporting columns 20 are metallic square pillars and each of them is positioned at each side of backward of the base 10, and, as shown in FIG. 4, comprises revolving hinges 20*a* and 20*b* to which the lifting mechanism 30 and the lever arms 40 are rotationally connected. The inside surfaces of the supporting columns 20, which face to each other, are formed with sliding ditches 20*c*.

The lifting mechanism 30 is metallic, and comprises a pair of lifting arms connected to each other at a hinge point 30*a* and provides a structure of three member linkage system as a whole; one end of the lifting mechanism is connected to the revolving hinge 20*a* at the base of the supporting column 20, the other end thereof moves upward or downward along the sliding ditch 20*c* formed inside the supporting columns 20.

Upward movement assisting device 33 is made of a spring member. One end thereof is fixed to an upper end supporting part 13*c* of the stopper 13 and the other end is fixed to the hinge point 30*a* of the lifting mechanism 30. Pulling force always acts on the hinge point 30*a* in a direction toward the stopper 13 (in a direction of Arrow C shown in FIG. 1). This force may be divided into a horizontal component force and a vertical component force, and the chair 50 gets an assisting force to rise by the vertical component force. In this exercise assisting instrument, the spring member is used, but other elastic materials such as rubber may be substituted.

Figure 5:
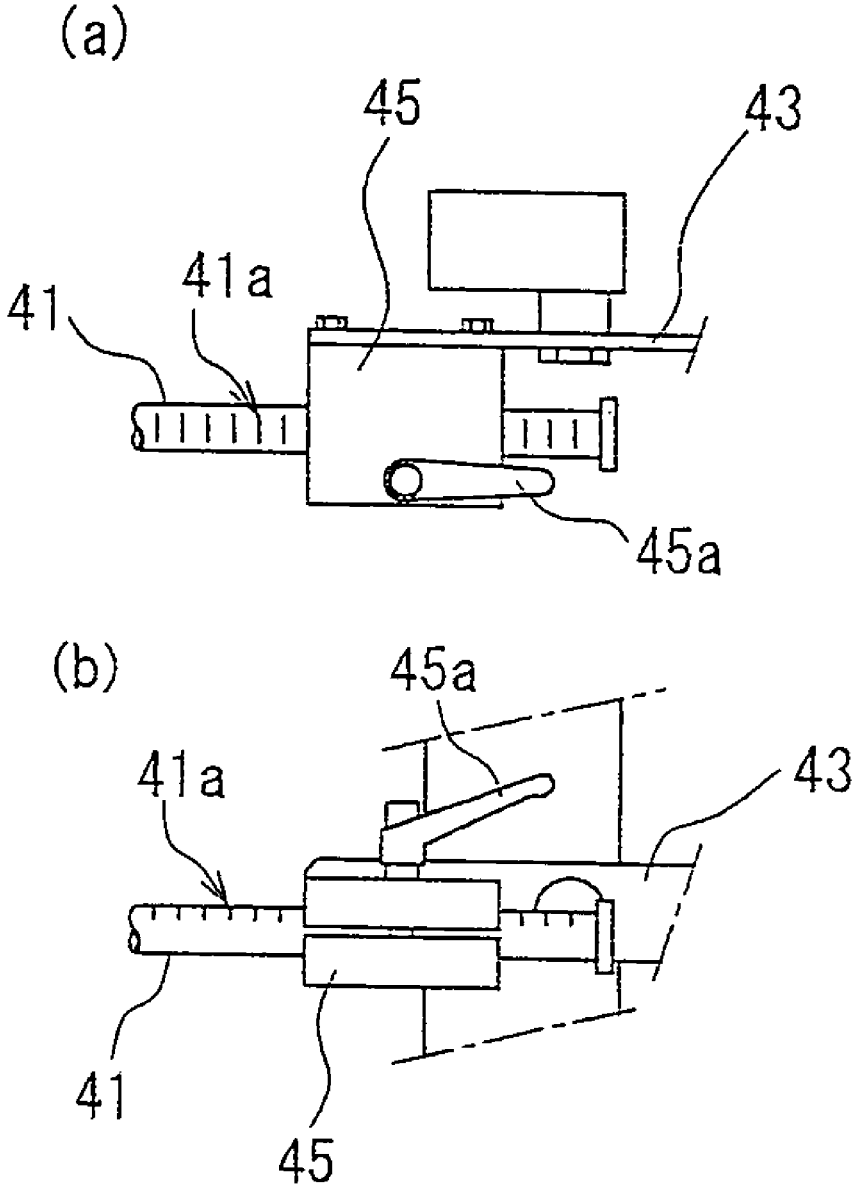
FIG. 5A is a side view of a fixing device.
FIG. 5B is a plan view of the same.

Each of the lever arms 40 comprises a handle pipe 41, an arm 43, a fixing device 45 and a grip 47, as shown in FIGS. 1 and 5.

The handle pipe 41 is metallic and is shaped to a bent letter-L-configuration. At one end of the handle pipe 41, the grip 47 is attached for the user to grip easily and, at the other end thereof, the arm 43 is connected to the handle pipe 41 by the fixing device 45. At the end of the arm 43 where the fixing device 45 is equipped, length of the handle pipe 41 may be changed according to the user's body size. Further, at the end of the handle pipes 41 where the fixing device 45 is equipped, graduation 41*a* is marked.

The arm 43 is metallic and is shaped to large-curve, and one end thereof is connected to the handle pipes 41 by the fixing device 45. And, as shown in FIG. 1, the arm 43 is formed with a guide groove 43*a* having a fixed width along the curve-shaped part of the arm 43. The hinge point 30*a* of the lifting mechanism 30 moves along the guide groove 43*a* in conjunction with the movement of the lever arm 40.

As shown in FIG. 5, the fixing device 45 is provided for connecting and fixing the handle pipe 41 and the arm 43. The user can set up and fix the length of the handle pipe 41 as he/she likes with referring to the graduation 41*a* of handle pipes 41 by means of a fixing lever 45*a*.

The grip 47 is made of resin and is installed detachably at the end of the handle pipes 41. The grip 47 is exchangeable and the most suitable to the size and the gripping force of the user's hand may be chosen. Further, resin material and thickness may be exchangeable at the user's will, so not only leg-and-knee-bending exercise but also training of the grip may be expected.

A counter 49 is positioned at the end of the grips 47, and automatically counts a number of upward and downward movements of the lever arms 40. Accordingly, the user may easily confirm the number of knee-bending exercise by oneself. And, the counter 49 is removable so that the user may perform the knee-bending exercise for multipurpose efficiently by exchanging the counter with a counter having alarm function or calorie-calculating function.

Then, action of the exercise assisting instrument 1 explained above will be described. First, the user gets on the base 10, places his/her both feet on the slip stoppers 15, and confirms the position of the feet. After the user sits down on the chair 50 so as to fit his/her feet at the slip stoppers 15, the position of the chair 50 in back and front direction is adjusted. Next, the user grips the grips 47 at the ends of the lever arms 40. At that time, the user adjusts the length of the right-and-left-pair of handle pipes 41 and fixes them with the fixing device 45. Next, the user resets the number of the counter 49 to "0" before starting the knee-bending exercise.

Then, the user stands up and pulls the lever arms 40 up toward the user (in the direction A shown in FIG. 1) with grasping the grips 47, the hinge point 30*a* of the lifting arm 30 comes off the locking device 11 to be unlocked. Since the chair 50 rises by link function of the lifting mechanism 30 and assisting force of the upward movement assisting device 33, the user may stand up undisturbedly. Further, the chair 50 inclines forward freely when the user stands up so that the front edge of the chair 50 does not bite into buttocks and thigh of the user. Since the chair 50 moves upward and downward in a state coming into contact with his/her buttocks all the time while he/she does the knee-bending exercise, the user may sit down or lean on the chair even at a time the user becomes unsteady and cannot help squatting down, and may go down to the lowest point slowly and safely.

Contrary to the above, if the user pushes down the lever arms 40 from its uppermost position (in the direction B shown in FIG. 1), the chair 50 goes downward and the user may squat while his/her buttocks coming into contact with the chair 50.

In usual knee-bending exercise, the chair 50 goes down to a position higher than an upper end of the stopper 13 and repeats lifting. Therefore, during usual use, the exercise assisting instrument 1 is not locked by the locking device 11 and the user may repeat knee-bending exercise smoothly.

In case that the user quits or discontinues knee-bending exercise, the user sits on the chair 50 and goes down to the lowest point. When the chair 50 reaches to the lowest point, the chair 50 hits the stopper 13 to stop and, at the same time, the lever arms 40 are locked by the locking device 11 and are stopped safely in a stable state.

Next, a second embodiment of the exercise assisting instrument according to the present invention will be described with referring to FIG. 6.

Figure 6:
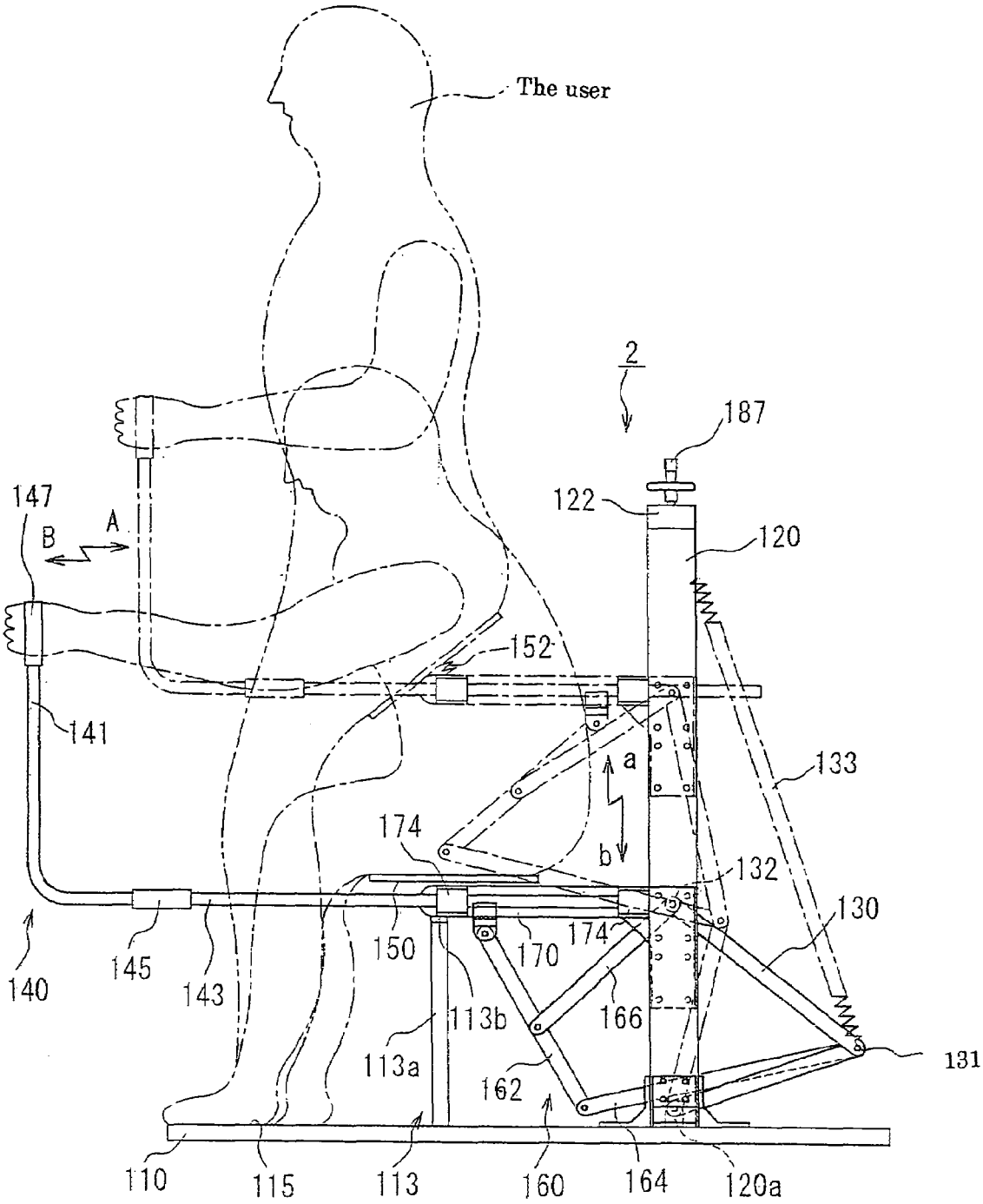
FIG. 6 is a side view of an exercise assisting instrument 2 of the second embodiment according to the present invention.

The exercise assisting instrument 2 of the present invention comprises a base 110, a pair of supporting columns 120, a pair of lifting mechanisms 130, a pair of lever arms 140, a chair 150, a lifting linkage 160, and a lifting base 170 as shown in FIG. 6.

Figure 7:
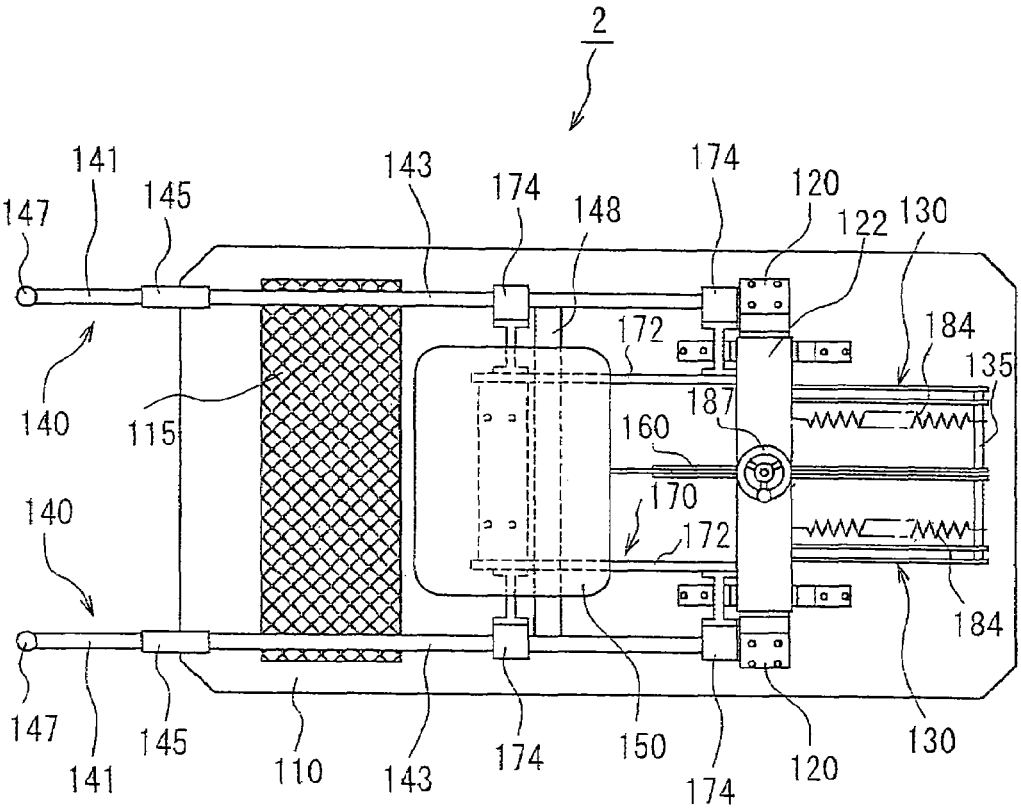
FIG. 7 is a plan view of the exercise assisting instrument 2 of the second embodiment according to the present invention.
Figure 8:
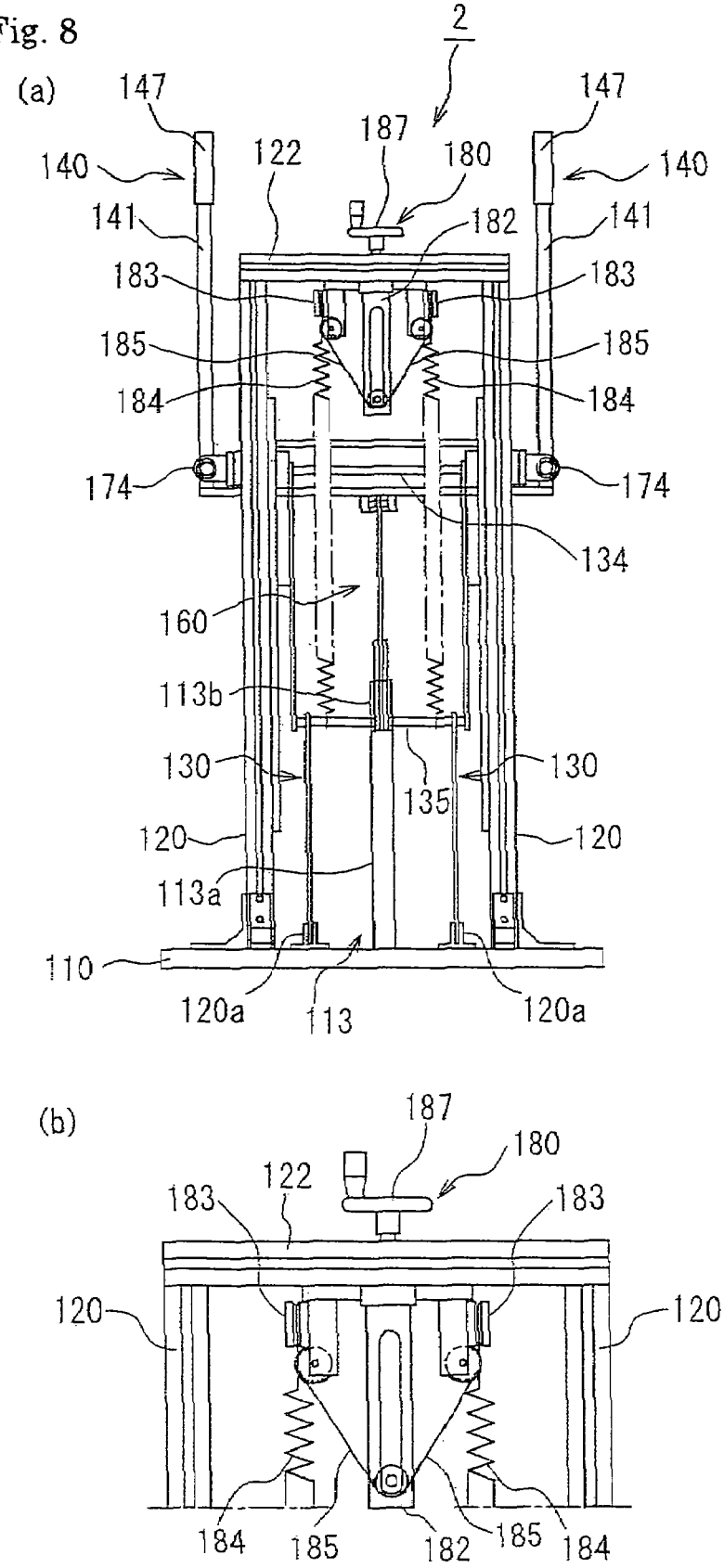
FIG. 8A is a back view of the exercise assisting instrument 2 of the second embodiment according to the present invention.
FIG. 8B shows an upward movement assisting device 180.

To the base 110, as shown in FIGS. 6~8, a stopper 113 for stopping the chair 150 at an appropriate lowest point with taking the user's safety into consideration, slip stoppers 115 to prevent slipping when the user does knee-bending exercise, and the paired supporting columns 120 to support the chair 150 to allow it to move upward and downward are integrated.

The base 110 is metallic and is made of a board member, the corners of which are chamfered so that the user may use it safely.

The stopper 113 is a metallic bar material, and, as shown in FIG. 6, comprises a stopper body 113*a* and a buffer rubber 113*b*. It is positioned almost in the center of the base 110 in wide direction and under the chair 150. The stopper 113 supports the chair 150 by means of the buffer rubber 113*b* for absorbing a shock at its upper end thereof when the chair 150 moves down to the lowest point. In this embodiment, the buffer rubber 113*b* is used to buffer shock of collision with the chair 150, but any buffer member that can absorb the shock as a whole such as a sponge and a spring may be substituted.

The slip stoppers 115 is made of rubber and cut ditch at the surface to make the slip resistance performance more effective. Each slip stopper 115 is positioned to an area where the foot of the user roughly fits in. Or, the same effect may be achieved by forming irregularity directly on the base 110, even though in the present embodiment the ditch cut rubber at the surface is used.

Figure 9:
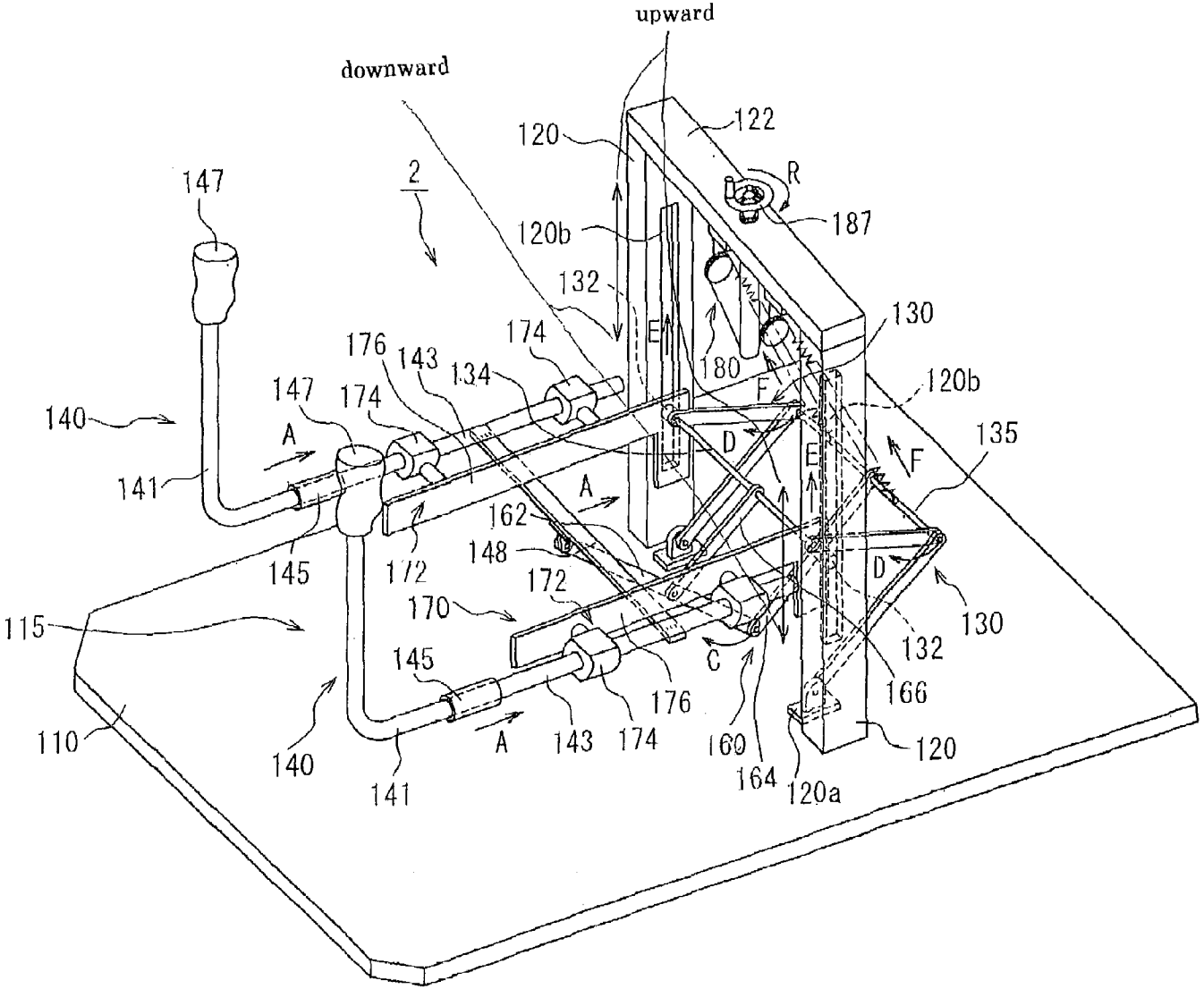
FIG. 9 is a perspective view of the exercise assisting instrument 2 of the second embodiment according to the present invention.

The supporting columns 120 are metallic square pillars and each of them is positioned at the back in a lengthwise direction of the base 110, and as shown in FIGS. 7~9, comprises a bridge member 122, an upward movement assisting device 180, and revolving hinges 120*a* which connect to the lifting mechanism 130. The inside surfaces of the supporting columns 120, which face to each other, are formed with sliding ditches 120*b* so that the chair 150 slides upward and downward.

The lifting mechanism 130 is metallic, and comprises two lifting arms connected to each other at a hinge point; one end of the lifting mechanism 130 is connected to a revolving hinge 120*a* near the base of the supporting column 120, and the other end thereof acts as a moving end 132, which moves upward and downward along the sliding ditch 120*b* formed inside the supporting columns 120. The lifting mechanism 130 and the supporting columns 120 as a whole provides a structure of linkage system.

Each of the lever arms 140 comprises a L-shaped member 141, a sliding member 143, and a length adjusting device 145, as shown in FIGS. 6, 7, and 9. The lever arms 140 are fixed to each other by a connecting member 148 under the chair 150 so that movement of each lever arm is limited.

Figure 10:
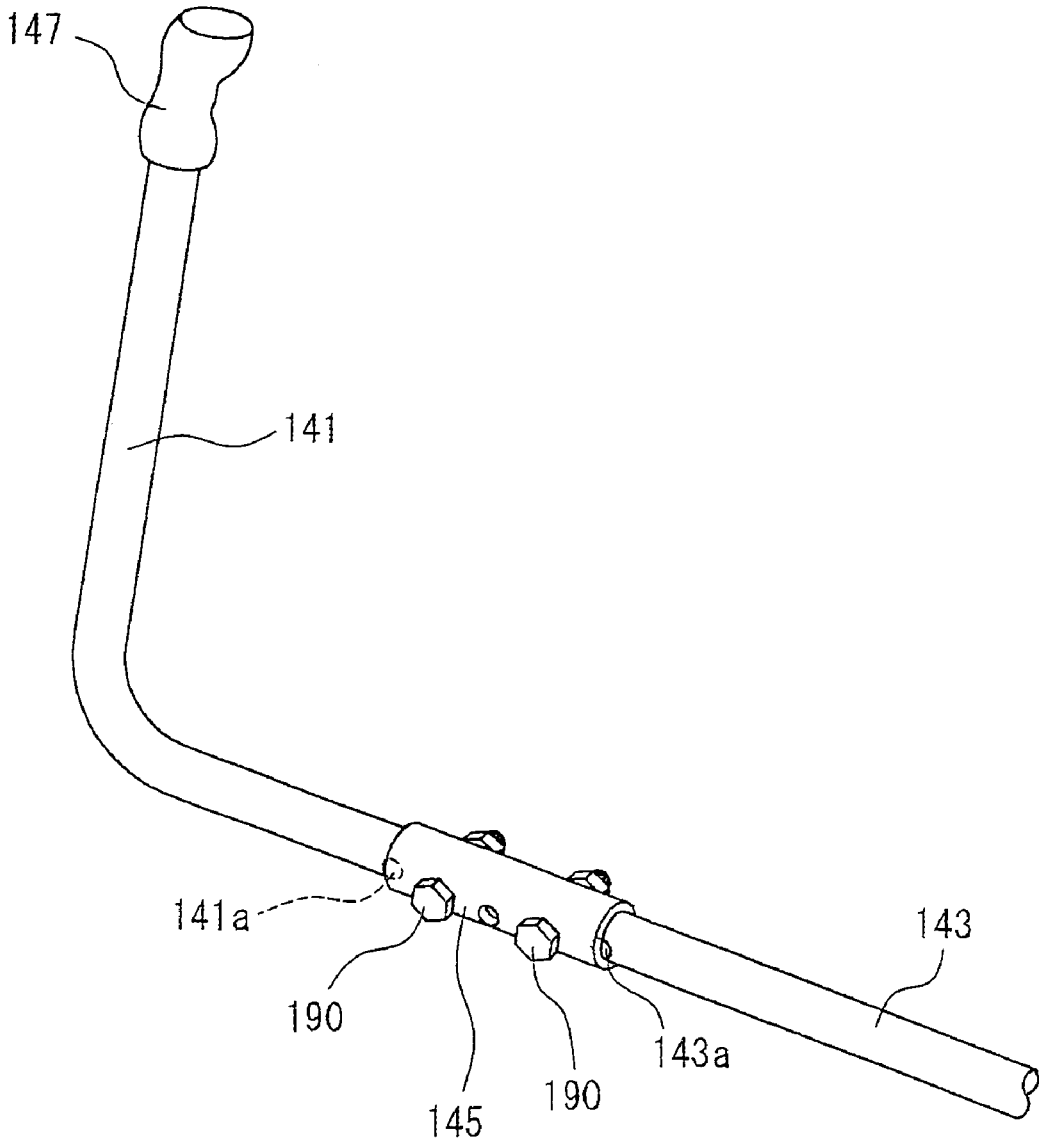
FIG. 10 is a perspective view showing a length adjusting device 145 of the second embodiment.

The L-shaped member 141 is metallic and, as shown in FIG. 10, comprises a grip 147 installed for the user to grip easily at one end and a connecting part 141*a* for connecting to the sliding member 143 by means of the length adjusting device 145 at the other end.

The sliding member 143 is metallic. One end of the sliding member is a connecting part 143*a* connected to the L-shaped member 141 through the length adjusting device 145 and the other end thereof is movably supported by a pair of supporting parts 174 of the lifting base 170.

As shown in FIG. 10, the length adjusting device 145 is metallic and hollow cylindrical member. The connecting part 141*a* of the L-shaped member 141 and the connecting part 143*a* of the sliding member 143 are fixed to each other with fastening means such as bolts 190 after inserting into the length adjusting device 145 from opposite ends thereof. Length of the lever arms 140 may be adjusted by changing the inserted lengths of the L-shaped member 141 and/or the sliding member 143 into the length adjusting device 145.

The grip 147 is made of resin and is installed detachably at the end of the L-shaped members 141. The grip 147 is exchangeable and the most suitable to the size and the gripping force of the user's hand may be chosen. Further, resin material and thickness may be exchangeable at the user's will, so not only leg-and-knee-bending exercise but also training of the grip may be expected.

The lifting linkage 160 is metallic, and, as shown in FIG. 6 or 9, comprises a first link member 162, a second link member 164, and a third link member 166. The first link member 162 and the second link member 164 are rotationally connected at their ends. One end of the third link member 166 is rotationally connected to the center or its vicinity of the first joint 162.

As shown in FIG. 6 or 9, one end of the first link member 162 of the lifting linkage 160 is rotationally connected to the center or its vicinity of the connecting member 148 that connects the paired lever arms 140. One end of the second link member 164 is rotationally connected to the center or its vicinity of a connecting member 135 that connects hinge joints 131 of the paired lifting mechanisms 130. One end of the third link member 166 is rotationally connected to the center or its vicinity of a connecting member 134 that connects the moving ends 132 of the paired lifting mechanisms 130.

The lifting base 170 comprises a pair of metallic L-shaped members 172 and the supporting parts 174. One end of the sliding member 143 of the lever arm 140 and the supporting parts 174, through which the former passes, compose a sliding system.

One end of the L-shaped member 172 fits into the sliding ditch 120*b* formed inside the supporting column 120 so that it moves upward and downward. The supporting parts 174 are established in outer sides 176 of the L-shaped members 172.

The chair 150 is positioned upon the paired L-shaped members 172. The angle of the chair 150 may be changed by means of spring 152 so that the chair 150 is positioned near the user's buttocks according to the user's movement.

As shown in FIGS. 8A and 8B, the upward movement assisting device 180 comprises a tension adjusting part 182, a pair of pulleys 183, a pair of tension springs 184, a string of wire 185 connected to the respective one ends of the paired tension springs 184 and guided by the pulleys 183, and an adjusting handle 187.

In this embodiment, the tension springs 184 are used, but other elastic material such as rubber may be used as long as it produces pulling tension to perform the same assisting effect as that of the present invention.

Tension adjusting part 182 is positioned at the center or its vicinity of the bridge member 122. At both sides of the tension adjusting part 182 the pulleys 183 are positioned. At the upper side of the bridge member 122, the adjusting handle 187, which is connected to the tension adjusting part 182, is positioned.

One end of the tension spring 184 is connected to the connecting member 135, which connects between the hinge points 131 of the paired lifting mechanisms 130, and the other end thereof is mechanically connected to the tension adjusting part 182 through the wire 185, which passes around the pulleys 183. When the adjusting handle 187 is turned, the wire 185 is pulled or loosened and the tension force of the tension springs 184 connected thereto may be adjusted.

Then, action of the exercise assisting instrument 2 explained above will be described with reference to FIG. 9. First, before using the exercise assisting instrument, the user adjusts in advance the length of the lever arms 140 with using the length adjusting device 145 so that it fits the user's body size and arm-length. Further, the user adjusts the assisting force of the upward movement assisting device 180 by turning the adjusting handle 187 in R-direction so that it fits the user's weight and physical condition. After finishing the preparation, the user gets on the base 110, places his/her both feet on slip stoppers 115, and confirms the position of the feet. The user sits down on the chair 150 so as to fit his/her feet at the slip stoppers 115, and then the position of the chair 150 in back and front direction is adjusted. Next, the user grips the grips 147 at the ends of the lever arms 140, and stands up with pulling the lever arms 140 up toward the user (in the direction A shown in FIG. 9). The chair 150 rises (in the direction E shown in FIG. 9) so that it positions near the user's buttocks by means of cooperative movement of the lifting mechanisms 130 (moving in the direction D shown in FIG. 9) and the lifting linkage 160 (moving in the direction C shown in FIG. 9). At this time, the chair 150 is urged upward by the assisting force given by the link function of the lifting mechanism 130 and the tension of the upward movement assisting device 180 so that the user may stand up undisturbedly. And, when the user stands up, the chair 150 inclines forward freely by means of spring 152 so that the front edge of the chair 150 does not bite into buttocks or thigh of the user. Since the chair 150 moves upward and downward in a state coming into contact with his/her buttocks all the time while he/she does the knee-bending exercise, the user may sit down or lean on the chair even at a time the user becomes unsteady and cannot help squatting down, and may go down to the lowest point slowly and safely due to the assisting force given by the upward movement assisting device 180.

Contrary to the above, if the user squats with pushing the lever arms 140 down from its uppermost position in the direction B shown in FIG. 6 (the opposite of direction A shown in FIG. 9), the chair 150 goes downward and the user may also go down while his/her buttocks comes into contact with the chair 150.

In case that knee-bending exercise is quitted or discontinued, the user sits on the chair 150 and goes down to the lowest point. When the chair 150 reaches to the lowest point, the chair 150 hits the stopper 113 to stop safely.

Next, a third embodiment of the exercise assisting instrument according to the present invention will be described with reference to FIG. 11.

Figure 11:
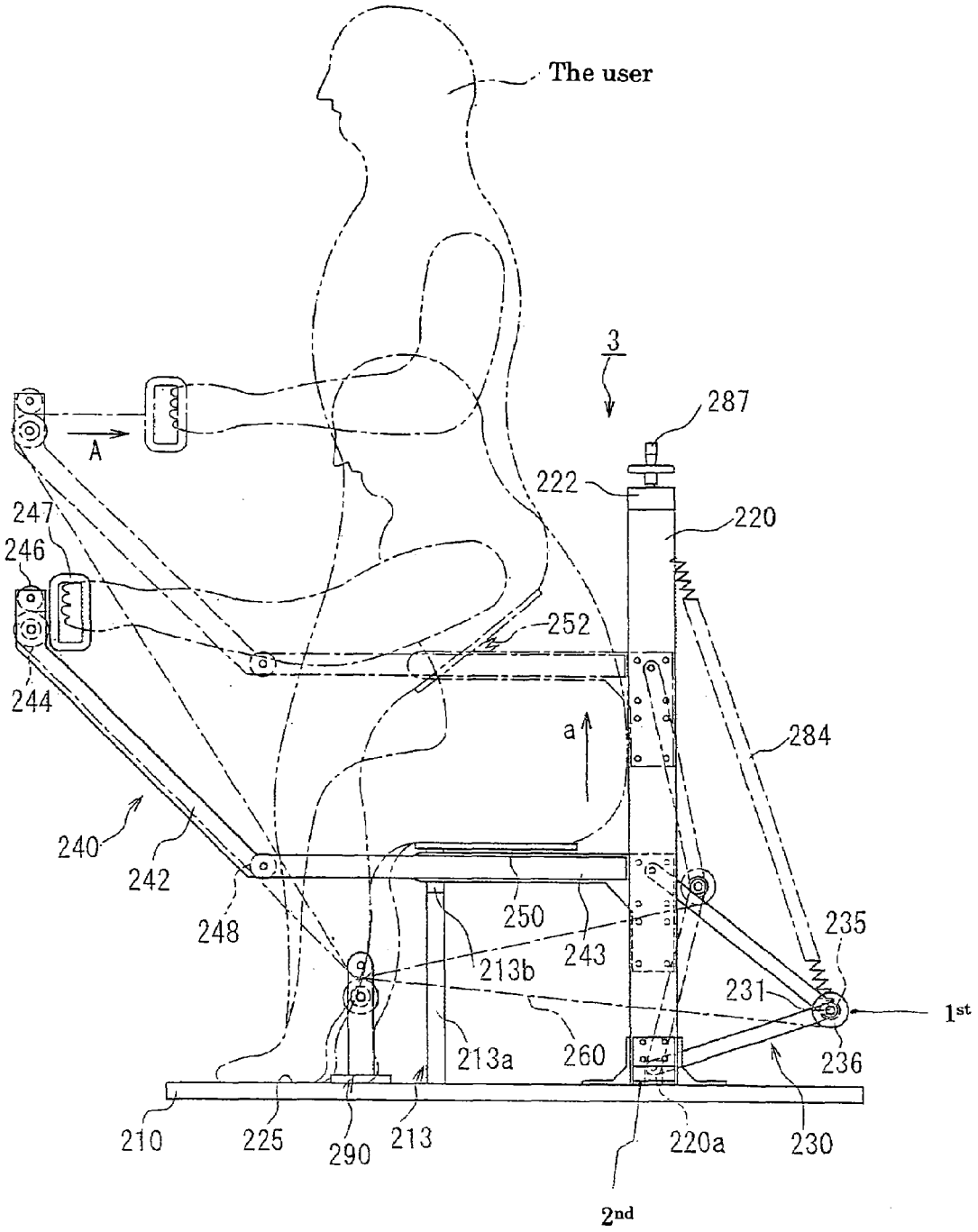
FIG. 11 is a side view of an exercise assisting instrument 3 of the third embodiment according to the present invention.

The exercise assisting instrument 3 of the present invention comprises a base 210, a pair of supporting columns 220, a pair of lifting mechanism 230, a pair of lever arms 240, a chair 250, and wires 260 as shown in FIG. 11.

Figure 12:
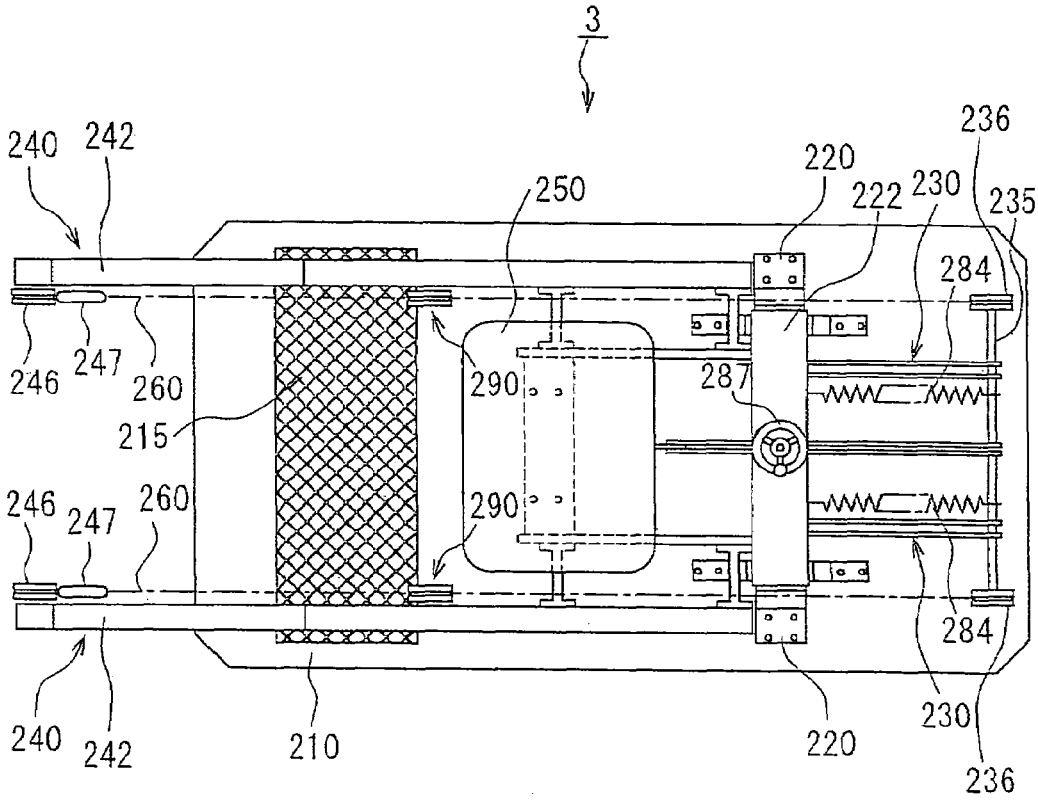
FIG. 12 is a plan view of the exercise assisting instrument 3 of the third embodiment according to the present invention.
Figure 13:
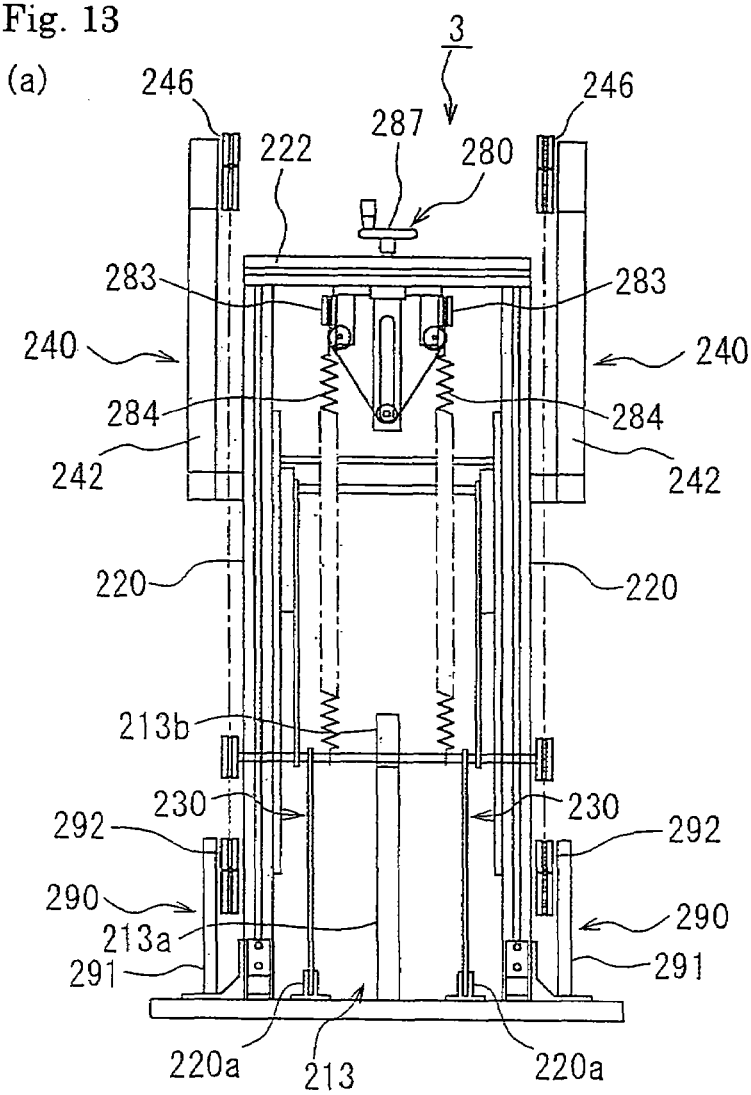
FIG. 13A is a back view of the exercise assisting instrument 3 of the third embodiment according to the present invention.
FIG. 13B shows an upward movement assisting device 280.
Figure 13:
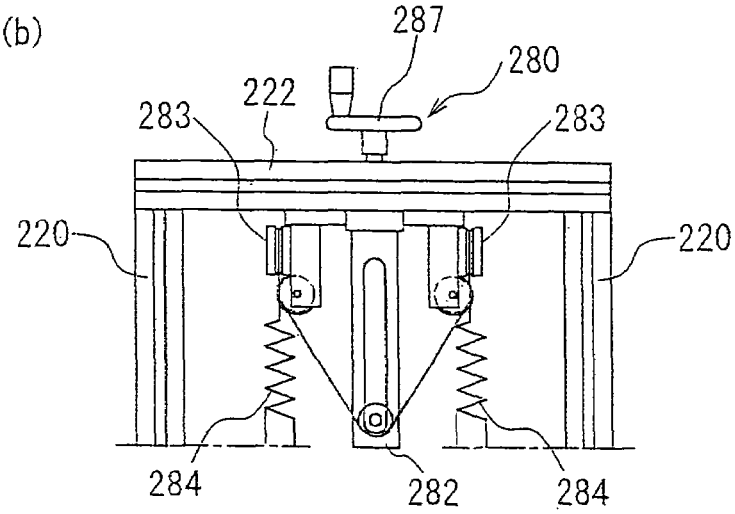

To the base 210, as shown in FIGS. 11~13, a stopper 213 for stopping the chair 250 at an appropriate lowest point with taking the user's safety into consideration, slip stoppers 215 to prevent slipping when the user does knee-bending exercise, the paired supporting columns 220 to support the chair 250 to allow it to move upward and downward, and a pair of wire guide devices 290 each for guiding the string of wire 260 are integrated.

The base 210 is metallic and is made of a board member, the corners of which are chamfered so that the user may use it safely.

The stopper 213 is a metallic bar material, and, as shown in FIG. 11, comprises a stopper body 213*a* and a buffer rubber 213*b*. It is positioned almost in the center of the base 210 in wide direction and under the chair 250. The stopper 213 supports the chair 250 by means of the buffer rubber 213*b* for absorbing a shock at its upper end thereof when the chair 250 moves down to the lowest point. In this embodiment, the buffer rubber 213*b* is used to buffer shock of collision with the chair 250, but any buffer member that can absorb the shock as a whole such as a sponge and a spring may be substituted.

The slip stoppers 215 is made of rubber and cut ditch at the surface to make the slip resistance performance more effective. Each slip stopper 215 is positioned to an area where the foot of the user roughly fits in. Or, the same effect may be achieved by forming irregularity directly on the base 210, even though in the present embodiment the ditch cut rubber at the surface is used.

Figure 14:
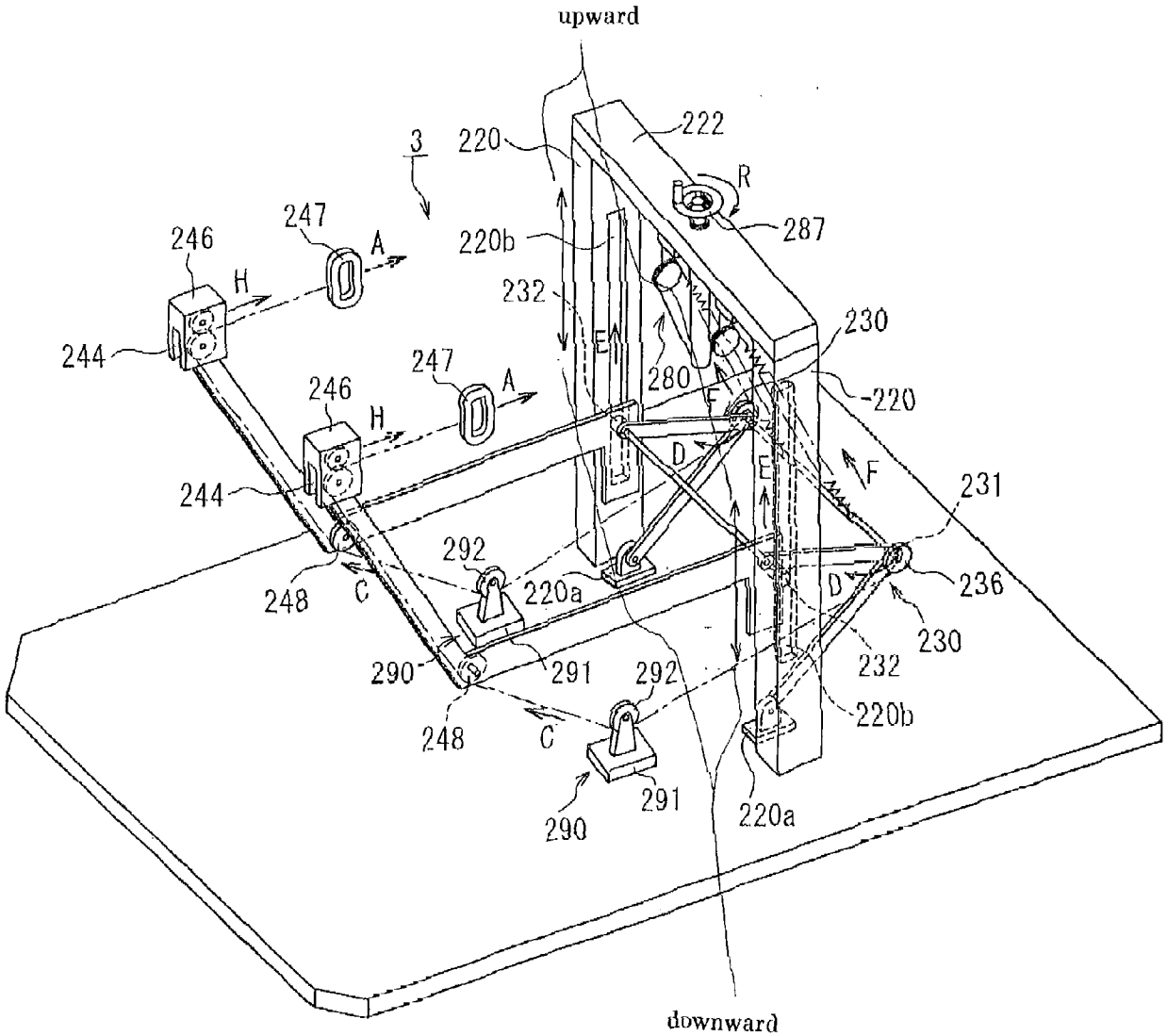
FIG. 14 is a perspective view of the exercise assisting instrument 3 of the third embodiment according to the present invention.

The supporting columns 220 are metallic square pillars and each of them is positioned at the back in a lengthwise direction of the base 210, and, as shown in FIGS. 13 and 14, comprises a bridge member 222, an upward movement assisting device 280, and revolving hinges 220*a* which connect to the lifting mechanism 230. The inside surfaces of the supporting columns 220, which face to each other, are formed with sliding ditches 220*b* so that the chair 250 slides upward and downward.

The wire guide device 290 comprises a pulley base 291 and a pulley 292. The wire 260 is guided around the pulley 292. The wire guide device 290 gives the wire 260 a tension so that the wire 260 can transfer the pulling force to the lifting mechanism 230 without being loosened when the user pulls grips 247.

The lifting mechanism 230 is metallic, and comprises two lifting arms connected to each other at a hinge point 231 to which one end of the wire 260 is connected. One end of the lifting mechanism 230 is connected to the revolving hinge 220*a* near the base of the supporting column 220, and the other end thereof acts as a moving end 232 which moves upward and downward along the sliding ditch 220*b* formed inside the supporting column 220. The lifting mechanism 230 and the supporting columns 220 as a whole provide a structure of three member linkage system.

Each of the lever arms 240, as shown in FIGS. 11~14, comprises a first arm member 242, a second arm member 243, an angle adjusting device 248 for rotationally connecting and fixing at a specific angle between the first arm member 242 and the second arm member 243, and a pulley part 246 for guiding the wire 260.

The first arm member 242 is metallic, and comprises at one end a fixing part 244 having a pulley 246. The other end of the first arm member 242 is connected to the second arm member 243 through the angle adjusting device 248.

The second arm member 243 is metallic. And, one end of the second arm member 243 slides upward and downward along the ditch 220*b* formed inside the supporting column 220 and the other end thereof is connected to the first arm member 242 through the angle adjusting device 248.

The pulley part 246 and the fixing part 244, as shown in FIG. 14, may be movable in the direction H in FIG. 14 and are fixed at a user's desired position through the angle adjusting device 248.

The wire 260 is made of high tension metallic wire, and at one end is connected to the grip 247 for the user to grip and at the other end is wounded and fixed to winding device 236 of the hinge point 231.

As shown in FIG. 11, when the user pulls grips 247 in the direction A, the wires 260 connected to them are also pulled and, at the same time, the hinge points 231 of the lifting mechanisms 230 connected to the other ends of wires 260 are pulled in the direction D whereby the moving ends 231 of the lifting mechanisms 230 rise (in the direction E in FIG. 14) in conjunction therewith.

The chair 250 is positioned upon arm bodies 241 fixed inside the second arm members 243, and may change its angle by means of spring 252.

As shown in FIGS. 13A and 13B, the upward movement assisting device 280 comprises an adjusting part 282, a pair of pulleys 283, a pair of tension springs 284, a string of wire 285 connected to respective one ends of the paired tension springs and guided by the pulleys 283, and an adjusting handle 287.

The tension adjusting part 282 is positioned at the center or its vicinity of the bridge member 222. At both sides of the tension adjusting part 282 the pulleys 283 are positioned. At the upper side of the bridge member 222, the adjusting handle 287, which is connected to the tension adjusting part 282, is positioned.

One end of the tension spring 284 is connected to a connecting member 235, which connects between the hinge points 231 of the paired lifting mechanisms 230, and the other end thereof is mechanically connected to the tension adjusting part 282 through the wire 285, which passes around the pulleys 283. When the adjusting handle 287 is turned, the wire 285 is pulled or loosened and the tension force of the tension springs 284 connected thereto may be adjusted.

Then, action of the exercise assisting instrument 3 explained above will be described. First, before using the exercise assisting instrument 3, the user adjusts and fixes the position of the pulley part 246 in advance by changing the angle of the first arm member 242 relative to the second arm member 243 by means of the angle adjusting device 248, which is installed at the lever arm 240, so that it fits the user's body size and arm-length of the user. After the preparation is finished, the user gets on base 210, places his/her both feet on slip stoppers 215, and confirms the position of the feet. The user sits down on the chair 250 so as to fit his/her feet at the slip stoppers 215 and then the position of chair 250 in back and front direction is adjusted. Then, the user grips the grips 247 with sitting down on the chair 250, the user adjusts the length of the wire 260 corresponding to the length of the user's arm by winding it around the winding device 236 to set the length of the wire 260 a specific length. After the adjustments above are finished, the user stands up and pulls the grips 247 up toward the user (in the direction A shown in FIG. 11) with gripping the grips 247. The chair 250 rises (in the direction E shown in FIG. 13) so that it positions near the user's buttocks by means of cooperative movement of the hinge points 231 of the lifting mechanisms 230, which move in the direction D shown in FIG. 11. At this time, the chair 250 is urged upward by assisting force given by the link function of the lifting mechanisms 230 and the tension of the upward movement assisting device 280 so that the user may stand up undisturbedly. And, when the user stands up, the chair 250 inclines forward freely so that the front edge of the chair 250 does not bite into buttocks or thigh of the user. Since the chair 250 moves upward and downward in a state coming into contact with his/her buttocks all the time while he/she does the knee-bending exercise, the user may sit down or lean on the chair even at a time the user becomes unsteady and cannot help squatting down, and may go down to the lowest point slowly and safely.

Contrary to the above, if the user squats down with pushing the grips 247 out, the chair 250 goes downward and the user may also go down slowly with the assisting force of the upward movement assisting device 280 while his/her buttocks comes into contact with the chair 250.

In case that the knee-bending exercise is quitted or discontinued, the user sits on the chair 250 and goes down to the lowest point. When the chair 250 reaches to the lowest point, the chair 250 hits the stopper 213 to stop safely.

Finally, a fourth embodiment of the exercise assisting instrument according to the present invention will be described with reference to FIGS. 15~19.

Figure 15:
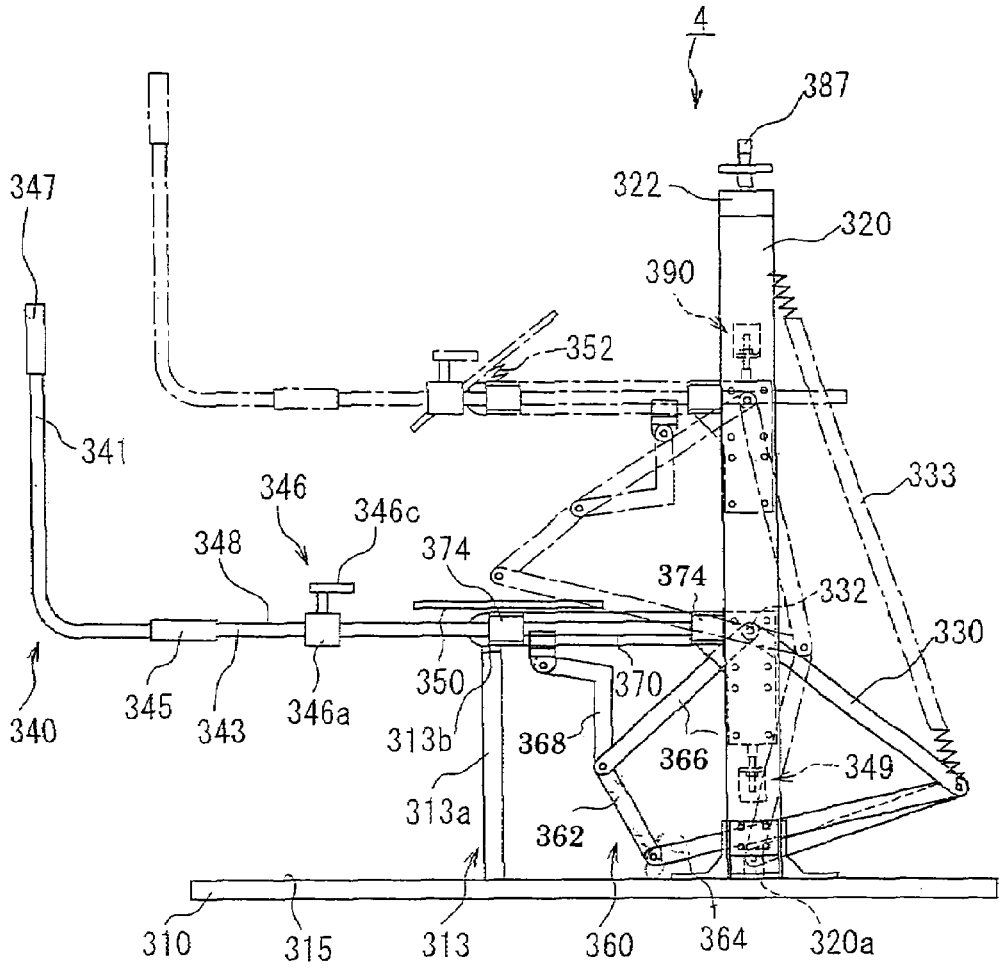
FIG. 15 is a side view of an exercise assisting instrument 4 of the fourth embodiment according to the present invention.
Figure 16:
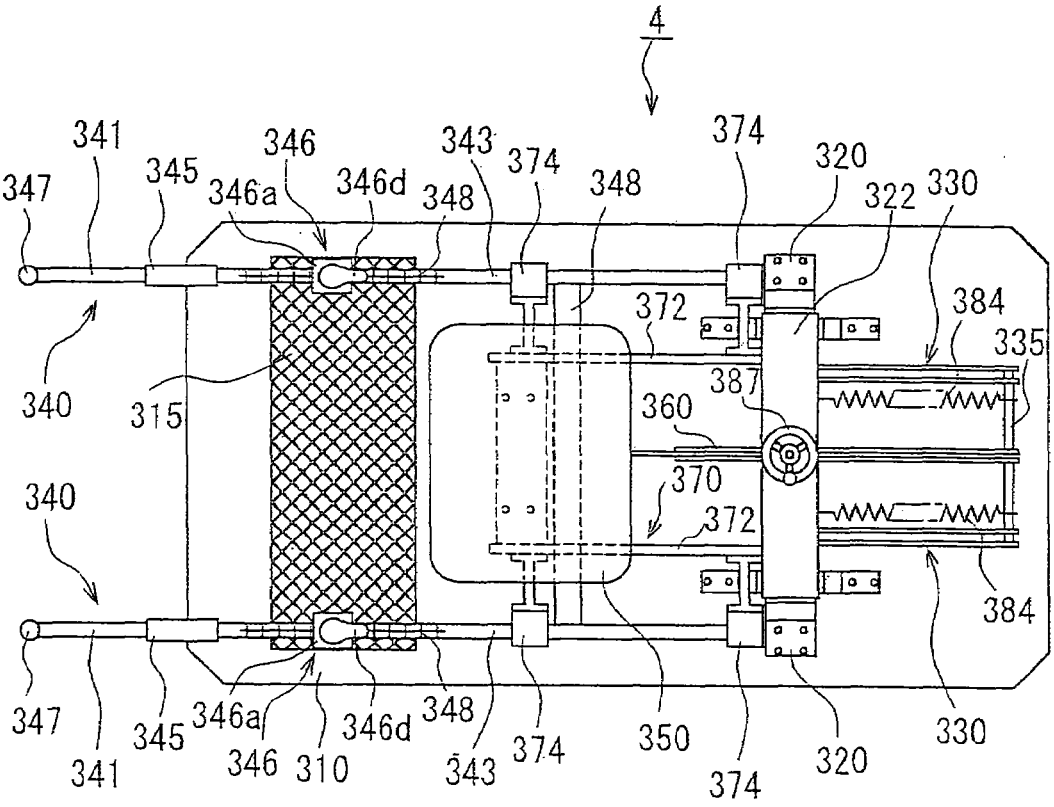
FIG. 16 is a plan view of the exercise assisting instrument 4 of the fourth embodiment according to the present invention.
Figure 17:
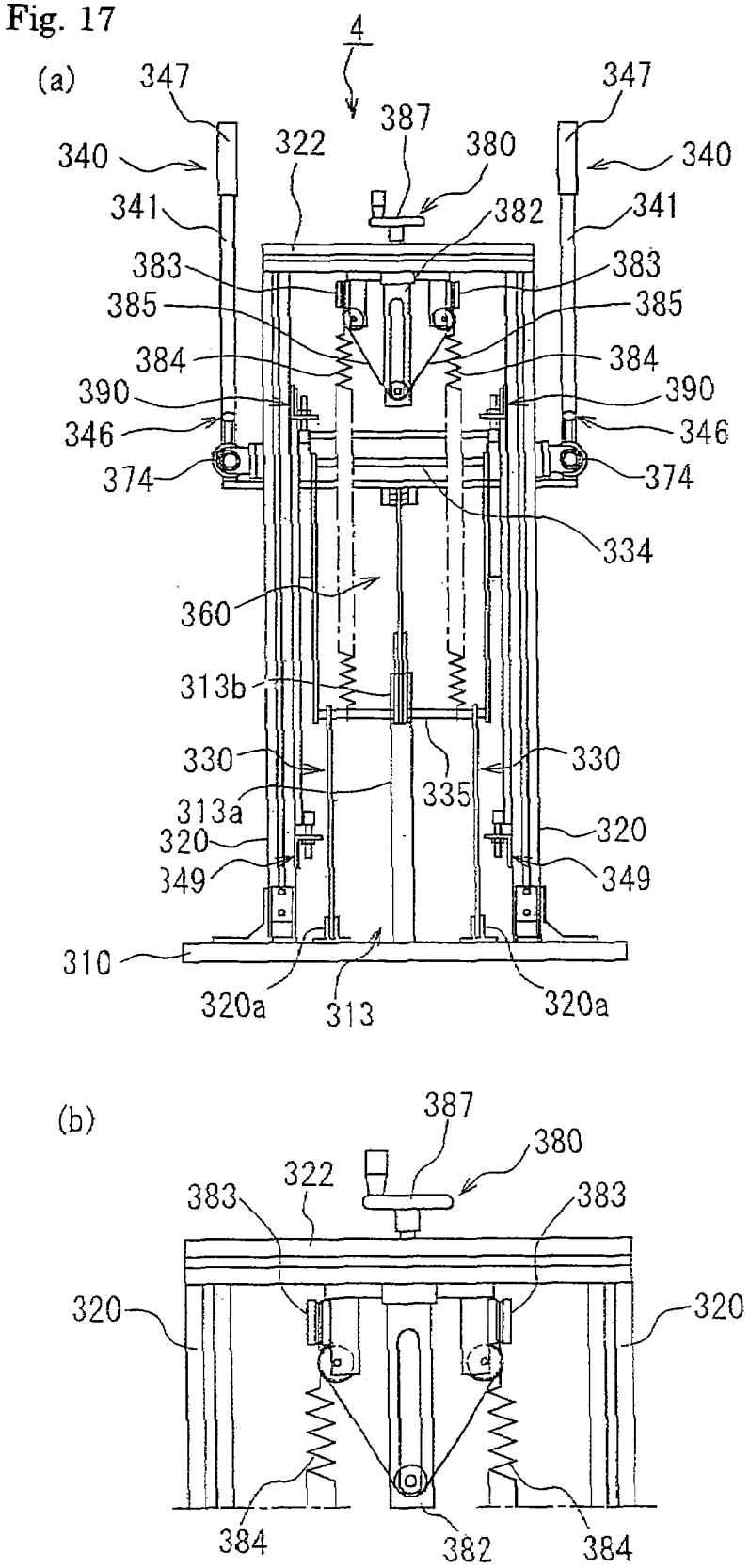
FIG. 17A is a back view of the exercise assisting instrument 4 of the fourth embodiment according to the present invention.
FIG. 17B shows an upward movement assisting device 380.

The exercise assisting instrument 4 of the present invention comprises a base 310, a pair of supporting columns 320, a pair of lifting mechanisms 330, a pair of lever arms 340, a chair 350, a lifting linkage 360, and a lifting base 370 as shown in FIG. 15 or 16.

To the base 310, as shown in FIG. 15 or 16, a stopper 313 for stopping the chair 350 at the lowest point for the user's safety, slip stoppers 315 to prevent slipping when the user does knee-bending exercise and the paired supporting columns 320 to support the chair 350 to allow it to move upward and downward are integrated.

The base 310 is metallic and is made of a board material, the corners of which are chamfered so the user may use it safely.

The stopper 313 is a metallic bar material, and, as shown in FIG. 15, comprises a stopper body 313*a* and a buffer rubber 313*b*.It is positioned almost in the center of the base 310 in wide direction and under the chair 350. The stopper 313 supports the chair 350 by means of the buffer rubber 313*b* for absorbing a shock at its upper end thereof when the chair 350 moves down to the lowest point. In this embodiment, the buffer rubber 313*b* is used to buffer shock of collision with the chair 320, but any buffer member that can absorb the shock as a whole such as a sponge and a spring may be substituted.

The slip stoppers 315 is made of rubber and cut ditch at the surface to make the slip resistance performance more effective. Each slip stopper 315 is positioned to an area where the foot of the user roughly fits in. Or, the same effect may be achieved by forming irregularity directly on the base 310, even though in the present embodiment the ditch cut rubber at the surface is used.

Figure 19:
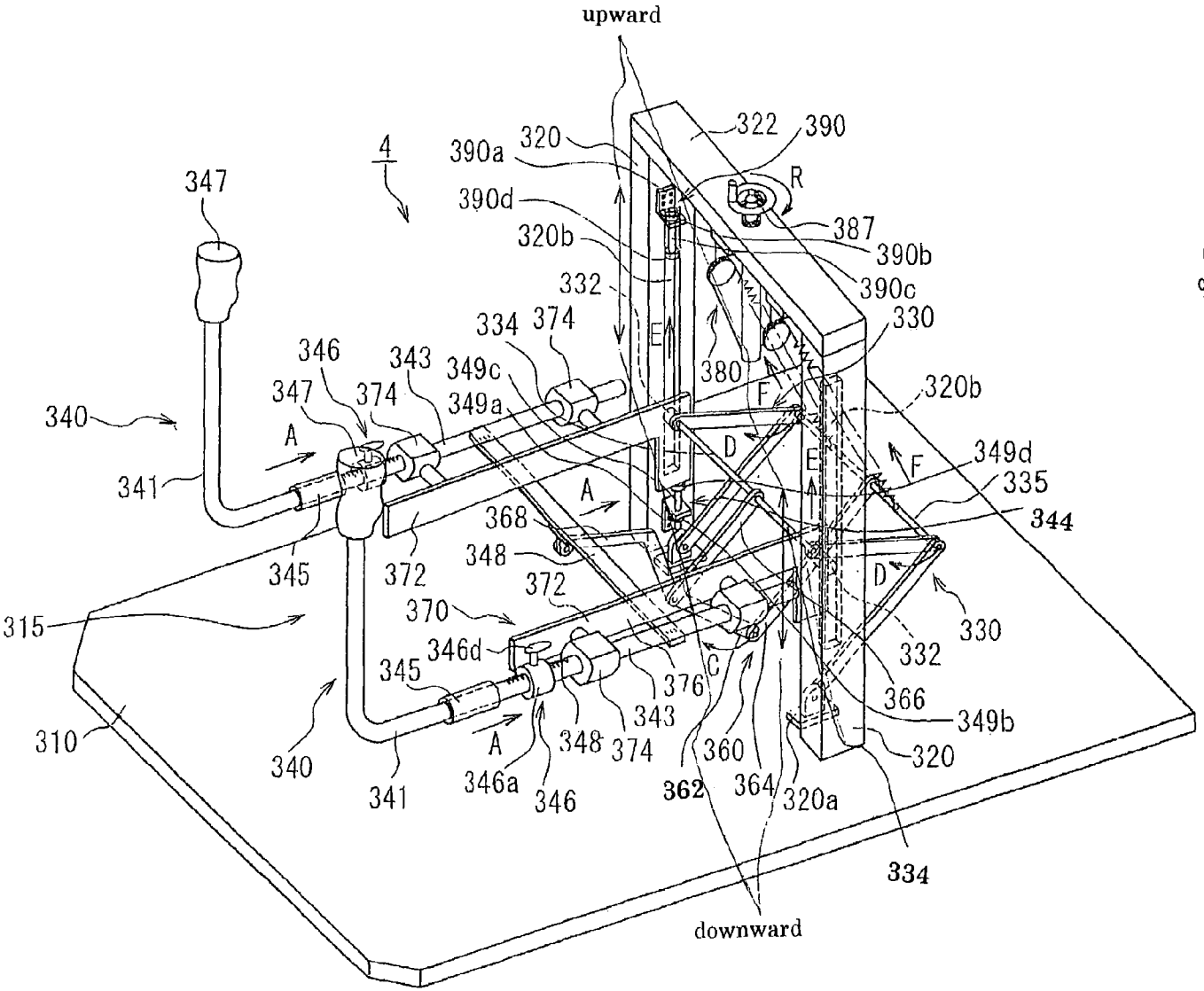
FIG. 19 is a perspective view of the exercise assisting instrument 4 of the fourth embodiment according to the present invention.

The supporting columns 320 are metallic square pillars and each of them is positioned at the back in a lengthwise direction of the base 310, and, as shown in FIGS. 15, 16 and 19, comprises a bridge member 322, an upward movement assisting device 380, and revolving hinges 320*a* which connect to the lifting mechanism 330. The inside surfaces of the supporting columns 320, which face to each other, are formed with sliding ditches 320*b* so that the chair 350 slides upward and downward along the sliding ditches 320*b*.

The lifting mechanism 330 is metallic, and comprises two lifting arms connected to each other at a hinge point 331. One end of the lifting mechanism 330 is connected to the revolving hinge 320*a* near the base of the supporting column 320, and the other end thereof acts as a moving end 332 which moves upward and downward along the sliding ditch 320*b* formed inside the supporting column 320. The lifting mechanism 330 and the supporting columns 320 as a whole provide a structure of linkage system.

Figure 18:
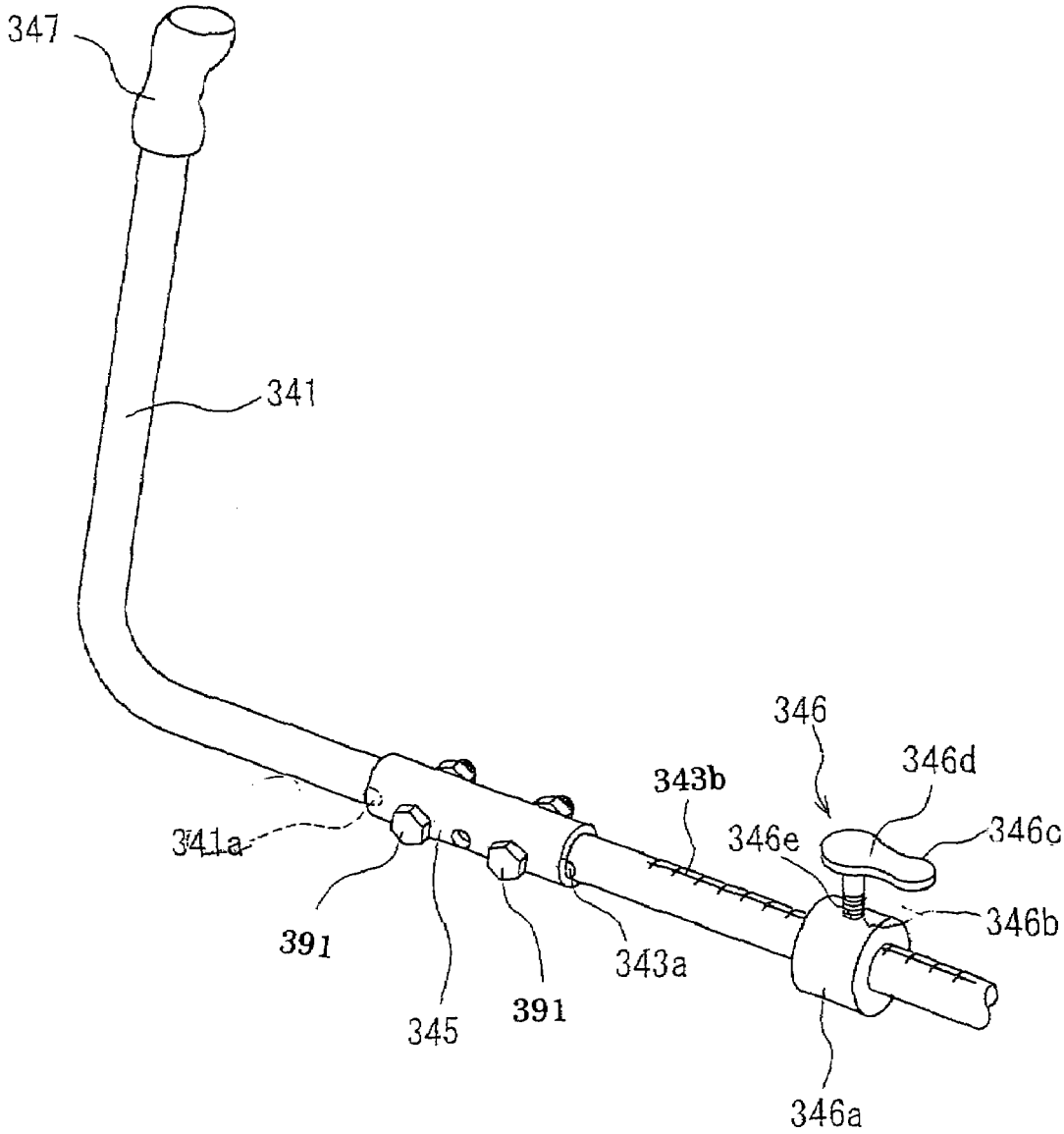
FIG. 18 is a perspective view showing a length adjusting device 345 of the fourth embodiment.

Each of the lever arms 340 comprises a L-shaped member 341, a sliding member 343, a length adjusting device 345, an upward movement stopper 346, and a graduation 343*b*, as shown in FIGS. 15, 16 and 18. The paired lever arms 340 are fixed under the chair 350 by means of a connecting member 348 thereby movement of the lever arms being limited.

The L-shaped member 341 is metallic and comprises a grips 347 installed for the user to grip easily at one end and at the other end a connecting part 341*a* to connect with the sliding member 343 through the length adjusting device 345.

The sliding member 343 is metallic and one end is a connecting part 343*a*, with which the L-shaped member 341 is connected through the length adjusting device 345, and the other end is supported movably by a pair of supporting parts 374 of the lifting base 370.

As shown in FIG. 18, the length adjusting device 345 is metallic and is made of hollow cylindrical member. The L-shaped member 341 and the sliding member 343 are inserted into the opposite ends of the length adjusting device 345 and fixed with fastening members 391 such as bolts and nuts. The length of the lever arms 340 may be adjusted by changing length inserted of the L-shaped member 341 and/or the sliding member 343.

As shown in FIG. 18, the upward movement stopper 346 comprises a cylinder 346*a* and a handle 346*c*.

The cylinder 346*a* is metallic and a hollow cylindrical member, and female screw 346*b* is formed at a bore formed thereon.

At one end of the handle 346*c*, a head 346*d* is provided for the user to grip, and at the other end a male screw 346*e* is formed.

The sliding member 343 of the lever arm 340 is inserted into the cylinder 346*a*, at which the graduation 343*b* is formed, and the fastening screw 346*e* formed at one end of the handle 346*c* is fastened into the female screw 346*b* formed at the cylinder 346*a* thereby the upward movement stopper 346 and the sliding member 343 being fixed.

Since the upward movement stopper 346 is provided, upward movement of the chair 350 beyond a predetermined limit may be stopped. Thus, when the user pulls the lever arms 340 with standing up, the upward movement stopper 346 abuts against one of the supporting parts 374 so that the chair 350 may be stopped. In other words, by adjusting a position of the upward movement stopper 346 with reference to the graduation 343*b*, the upper limit of the chair 350 may be set corresponding to the user's height etc.

Figure 20:
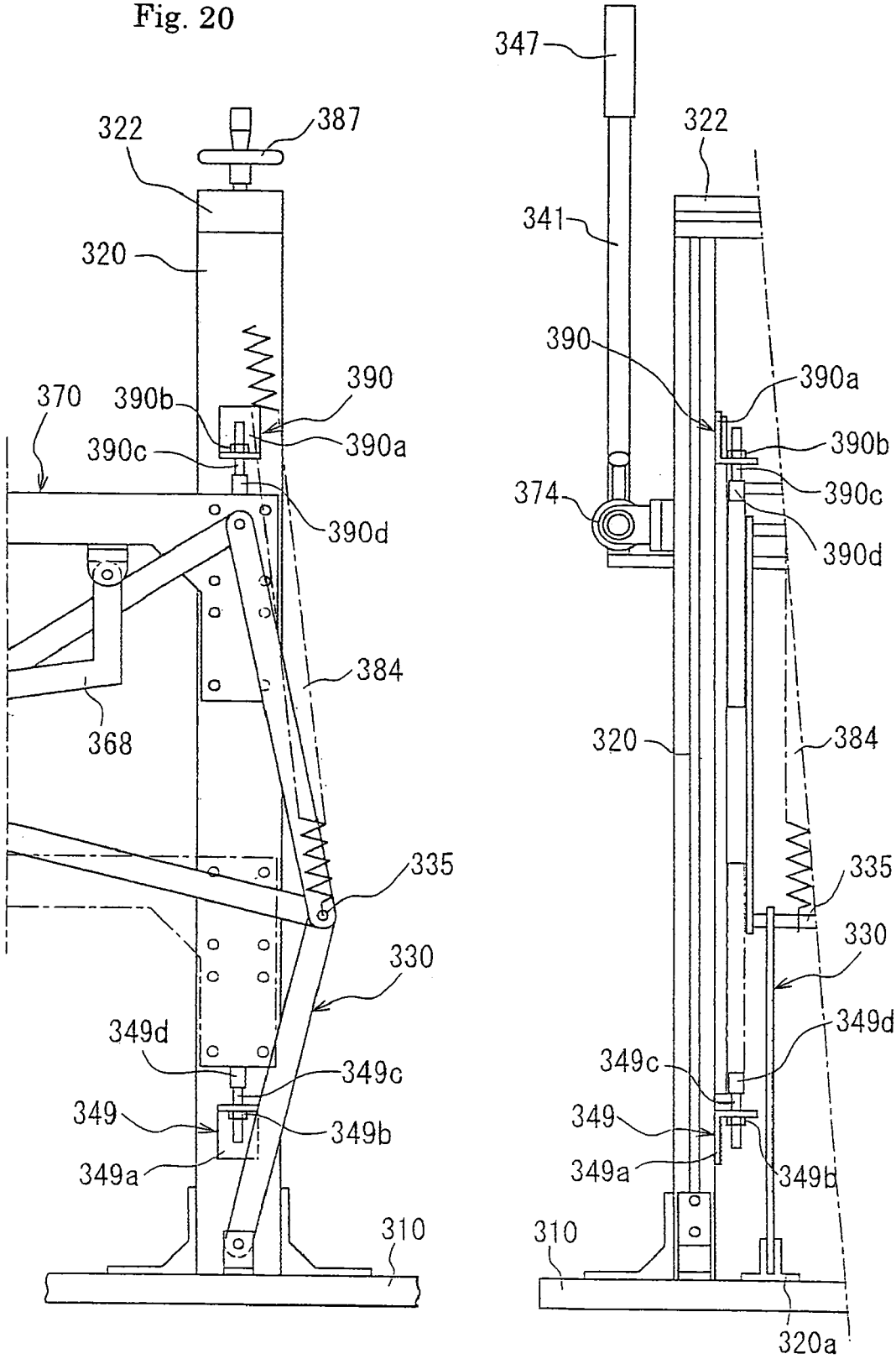
FIG. 20 is an embodiment of the upward movement stopper 390 and a downward movement stopper 349 of the fourth embodiment according to the present invention.

In the present embodiment, the upward movement stopper 346 is provided on the lever arms 340, but as the second embodiment of the upward movement stopper, as shown in FIGS. 19 and 20, an upward movement stopper 390 may be used at the upper end of the supporting column 320 thereby the upper limit of the lifting base 370, which moves upward and downward along the sliding ditch 320, being set.

The upward movement stopper 390 according to the second embodiment comprises a L-shaped metallic member 390*a*, a fixing nut 390*b*, an adjusting bar 390*c*, and a buffer rubber 390*d*. The buffer rubber 390*d* is detachably fixed at one end of the adjusting bar 390*c*. The adjusting bar 390*c* is adjusted its length at other end thereof and fixed by means of the L-shaped metallic member 390*a* and the fixing nut 390*b* corresponding to the height of the user.

Further, as shown in FIGS. 19 and 20, a downward movement stopper 349 may be also provided at the base of the supporting columns 320 together with the upward movement stopper 390 so that a range of lifting movement of the lifting base 370 may be limited.

The downward movement stopper 349 comprises a L-shaped metallic member 349*a*, a fixing nut 349*b*, an adjusting bar 349*c*, and a buffer rubber 349*d*. The buffer rubber 349*d* is detachably fixed at one end of the adjusting bar 349*c*. The adjusting bar 349*c* is adjusted its length at other end thereof and fixed by means of the L-shaped metallic member 349*a* and the fixing nut 349*b* corresponding to the height of the user's legs.

In the present embodiment, the stopper 313 is provided for limiting the lowermost position of the chair 350 so that the stopper 313 abuts the chair 350 to stop thereat when the user gets tired or is about to fall down. On the other hand, the downward movement stopper 349, used with the upward movement stopper 390, may set and limit a specified range of upward-downward movement according to the level of knee-bending-ability of the user. For example, by changing the positions of the upward movement stopper 390 and the downward movement stopper 349, a range of knee-bending may be widened. As a result of training with using the exercise assisting instrument according to the present invention, the user may gradually widen the range of knee-bending. Under such circumstances, the user may confirm such effect given by the present exercise assisting instrument when he/she records the positions set of the stoppers.

Moreover, in the present embodiment, the upward movement stopper 346 or 390 is used, but its' use is not limited to those described above, and it may be any forms in which the position of the chair is set near the user's buttocks when the user starts exercise.

The grip 347 is made of resin and is installed detachably at the end of the L-shaped members 341. The grip 347 is exchangeable and the most suitable to the size and the gripping force of the user's hand may be chosen. Further, resin material and thickness may be exchangeable at the user's will, so not only leg-and-knee-bending exercise but also training of the grip may be expected.

The lifting linkage 360 is metallic, and as shown in FIGS. 15 and 19, comprises a first link member 362, a second link member 364, a third link member 366, and a fourth L-shaped link member 368. The one end of the first link member 362 and the one end of the second link member 364 are rotationally connected to each other. The other end of the first link member 362 and one end of the fourth link member 368 are rotationally connected to each other at hinge point to which one end of the third link member 366 is rotationally connected. Those of the link members structure a linkage system and make the chair 350 to lift by cooperative function with the lifting mechanism 330.

As shown in FIG. 15 or 19, the other end of the fourth link member 368 of the lifting linkage 360 is rotationally connected at the center or its vicinity of the connecting member 348 which connects the paired lever arms 340. The other end of the second link member 364 is connected to a connecting member 335 which connects the hinge points of the paired lifting mechanisms 330. And, the other end of the third link member 366 is connected to a connecting member 334, which connects the moving ends 332 of the paired lifting mechanisms 330.

The lifting base 370 comprises a pair of metallic L-shaped members 372 and the supporting parts 374. The supporting parts 374, through which one end of the sliding member 343 of the lever arm 340 is inserted to slide, constitutes a sliding system.

One ends of the paired L-shaped members 372 are connected to the sliding ditches 320*b* established inside of the supporting columns 320, along which they move upward and downward. The paired supporting parts 374 are fixed to each of outer sides 376 of the paired L-shaped members 372.

The chair 350 is positioned upon the paired L-shaped members 372, and may change its angle by means of spring 352 so that it may position near the user's buttocks during the exercise.

As shown in FIGS. 17A and 17B, the upward movement assisting device 380 comprises an adjusting part 382, a pair of pulleys 383, a pair of tension springs 384, a string of wire 385 connected to respective one ends of the paired tension springs 384 and guided by the pulley 383, and an adjusting handle 387.

In this embodiment, the tension springs 384 are used, but other elastic material such as rubber may be used as long as it produces pulling tension to perform the same assisting effect as that of the present invention.

The tension adjusting part 382 is positioned at the center or its vicinity of the bridge member 322. At both sides of the tension adjusting part 382 the pulleys 383 are positioned. At the upper side of the bridge member 322, the adjusting handle 387, which is connected to the tension adjusting part 382, is positioned.

One end of the tension spring 384 is connected to the connecting member 335, which connects between the hinge points 331 of the paired lifting mechanisms 330, and the other end thereof is mechanically connected to the tension adjusting part 382 through the wire 385, which passes around the pulleys 383. When the adjusting handle 387 is turned, the wire 385 is pulled or loosened and the tension force of the tension springs 384 connected thereto may be adjusted.

Then, action of the exercise assisting instrument 4 explained above will be described with reference to FIG. 19. First, before using the exercise assisting instrument, the user adjusts in advance the length of the lever arms 340 with using the length adjusting device 345 so that it fits the user's body size and arm-length. Further, the user adjusts the assisting force of the upward movement assisting device 380 by turning the adjusting handle 387 in the R-direction so that it fits the user's weight and physical condition. After finishing the preparation, the user gets on the base 310, places his/her both feet on slip stoppers 315, and confirms the position of the feet. When the user sits down on the chair 350 from the his/her standing position, the user adjusts the position of the cylinder 346*a* of the upward movement stopper 346 so that the chair 350 is positioned at the height where the user easily sits down, and fixes the cylinder 346*a* by turning the head 346*d*. The user sits down on the chair 350 so as to fit his/her feet at the slip stoppers 315, and then the position of the chair 350 in back and front direction is adjusted. Next, the user grips the grips 347 at the ends of the lever arms 340, and stands up with pulling the lever arms 340 up toward the user (in the direction A shown in FIG. 19). The chair 350 rises (in the direction E shown in FIG. 19) so that it positions near the user's buttocks by means of cooperative movement of the lifting mechanisms 330 (moving in the direction D shown in FIG. 19) and the lifting linkage 360 (moving in the direction C shown in FIG. 19). At this time, the chair 350 is urged upward by assisting force given by the link function of the lifting mechanism 330 and tension of the upward movement assisting device 380 so that the user may stand up undisturbedly. And, when the user stands up, the chair 350 inclines forward freely so that the front edge of the chair 350 does not bite into buttocks or thigh of the user. Since the chair 350 moves upward and downward in a state coming into contact with his/her buttocks all the time while he/she does the knee-bending exercise, the user may sit down or lean on the chair even at a time the user becomes unsteady and cannot help squatting down, and may go down to the lowest point slowly and safely due to the assisting force given by the upward movement assisting device 380.

Contrary to the above, if the user squats with pushing the lever arms 340 down from its uppermost position in the direction B shown in FIG. 6 (the opposite of direction A shown in FIG. 19), the chair 350 goes downward and the user may also go down while his/her buttocks comes into contact with the chair 350.

In case that knee-bending exercise is quitted or discontinued, the user sits on the chair 350 and goes down to the lowest point. When the chair 350 reaches to the lowest point, the chair 350 hits the stopper 313 to stop safely.

If the user leaves the chair 350, the chair 350 rises automatically by the assisting force of the upward movement assisting device 380 to the position set by the upward movement stopper 346. Therefore, when the same user comes back and uses the exercise assisting instrument 4 next time, he/she may sit down on the chair 350 at the position where he/she easily sits down and may start exercising comfortably.

INDUSTRIAL APPLICABILITIES

According to the exercise assisting instrument of the present invention described above, in leg-and-knee-bending exercise or waist-and-arm exercise, a burden to the knee-bending exercise is lightened by the assisting force for extending his/her legs when standing up. Therefore, the user may easily do the knee-bending exercise corresponding to his/her physical strength.

Further, said exercise assisting instrument is equipped with the length adjusting mechanism for the lever arms and the position adjusting mechanism for the chair. Therefore, it may be adjusted to the user's body size in a range to a certain extent. Accordingly, the user may do the knee-bending exercise in the most suitable condition.

Furthermore, even at a time the user's physical strength goes to the limit and suddenly his/her knees and waist becomes unsteady and the user cannot help squatting down, to prevent bone-breaking accident, the chair moves upward and downward always in a state coming into contact with his/her buttocks so that the user may sit down on the chair from any position while he/she does the knee-bending exercise. The user may sit down on the chair as he/she lean on it and may go down to the lowest point slowly and safely with aid of upward force affecting the chair.

What is claimed is:

1. An exercise assisting instrument for assisting knee-bending exercise of a user comprising:

a base;

a pair of supporting columns spaced apart and standing vertically in parallel supported on the base;

a chair adapted to support a user's buttocks, the chair movable along an upright path between a downward position wherein a user may be seated thereon in a sitting posture and an upward position to assist the user to a standing posture; and a lifting device mounted to the supporting columns and to the chair and having a pair of lifting arms which are operated by the user for moving the chair upward and downward as the user does knee-bending exercises by moving between a downward sitting posture and an upward standing posture, wherein said lifting device comprises a respective one of the lifting arms having one end to be manipulated by a user and its other moving end operatively coupled to a respective one of a pair of sliding members slidable in a respective one of a pair of sliding slots formed in a respective one of the supporting columns for movement between downward and upward positions thereon, a lifting mechanism coupled to the other end of the lifting arm and the sliding member for upwardly biasing said sliding member in its sliding movement between the upward and downward positions upon operation of the lifting arm by the user, and a lifting member supported on the sliding member and coupled to the chair for moving the chair upward and downward in conjunction with operation of the lifting arm by the user so as to position the chair for supporting a user's body thereon near the buttocks of the user, which chair moves upward and downward together with the user doing the knee bending exercise, whereby the user doing the knee-bending exercise may be supported on the chair any time, accordingly the user may do the knee-bending exercise safely.

2. The exercise assisting instrument defined in claim 1 wherein said lifting device raises the chair in conjunction with pulling movement of the user's arms on the lifting arms when the user stands up.

3. The exercise assisting instrument defined in claim 1 wherein said lifting mechanisms and said lifting arms are connected to each other at first hinge points, one ends of the lifting mechanisms being rotationally connected to said base and other ends thereof moving upward and downward along said supporting columns, and said one ends serving as second hinge points;

a pair of lever arms having handle-parts at their ends for the user to grip, said lever arms being rotationally connected to the supporting columns at third hinge points, around which they swing upward and downward as seesaws;

a stopper for abutting the chair to stop when the chair moves down and reaches to the lowest point;

an upward movement assisting device for urging an assisting force in a direction that the other ends of the lifting mechanisms move upward; and a connecting member for connecting the first hinge points of the lifting arms to control the movement of said paired lever arms, wherein said lifting device partially assists standing-up movement of the user and lightens a burden of the knee-bending exercise when the user stands up and pulls said handle-parts of the lever arms upward with gripping of said handle-parts.

4. The exercise assisting instrument defined in claim 3 wherein said lever arms have length adjusting devices so the user may adjust the length thereof corresponding to the user's body size.

5. The exercise assisting instrument defined in claim 3 wherein said upward movement assisting device is made of an elastic member which is connected between said stopper and said connecting member.

6. The exercise assisting instrument defined in claim 1 wherein said lifting mechanisms and said lifting arms are connected to each other at first hinge points, one ends of said lifting mechanisms being rotationally connected to said base and other moving ends thereof moving upward and downward along said supporting columns, and said one ends serving as second hinge points;

a pair of lever arms having handle-parts at their ends for the user to grip;

a connecting member for connecting the first hinge points of the paired lifting arms to control the movement of said paired lever arms;

a lifting linkage having a linkage system for moving said moving ends of said lifting mechanisms upward and downward in conjunction with the movements of said lever arms;

a lifting base fixed to said moving ends of said lifting mechanisms, said lifting base moving upward and downward together with the upward-downward movement of said moving ends and having support means for supporting said lever arms to move backward and forward; and an upward movement assisting device for urging an assisting force in a direction that said moving ends of the lifting mechanism moves upward, wherein said lifting device partially assists standing-up movement of the user and lightens a burden of the knee-bending exercise when the user stands up and pulls said lever arms upward with gripping said handle-parts.

7. The exercise assisting instrument defined in claim 6 wherein said lever arms have length adjusting devices so that the user may adjust the length thereof corresponding to the user's body size.

8. The exercise assisting instrument defined in claim 1 wherein said lifting mechanisms and said lifting arms are connected to each other at first hinge points, one ends of said lifting mechanisms being rotationally connected to said base and other moving ends thereof moving upward and downward along said supporting columns, and said one ends serving as second hinge points;

a pair of lever arms which move upward and downward in conjunction with the upward-downward movement of said moving ends;

a connecting member for connecting the first hinge points of the paired lifting arms to control the movement of said paired lever arms;

a pair of wire members, each having an end which is used as a pulling end part pulled by the user and an other end which is connected at the first hinge point of said lifting arms so that the moving ends of said lifting arms may be moved upward by pulling said pulling end parts; and an upward movement assisting device for urging an assisting force in a direction that said lifting mechanism moves upward, wherein said lifting device partially assists standing-up movement of the user and lightens a burden of the knee-bending exercise when the user stands up and pulls said lever arms upward with gripping said handle-parts.

9. The exercise assisting instrument defined in claim 8 wherein said lifting arms have winding devices for winding said wire members at the first hinge points.

10. The exercise assisting instrument defined in claim 8 wherein said lever arms have an angle adjusting device so that the user may adjust the angle of said lever arms corresponding to the user's body size.

11. The exercise assisting instrument defined in claim 8 wherein said upward movement assisting device is made of an elastic member, which is connected between an upper end of said supporting column and the first hinge point of said lifting arms.

12. The exercise assisting instrument defined in claim 1 wherein said chair moves upward and downward in conjunction with the upward-downward movement of the moving ends of said lifting arms, wherein said exercise assisting instrument further includes a movement stopper to stop said chair at a designated position of height.

13. The exercise assisting instrument defined in claim 1 wherein said chair has an adjusting device for moving the chair backward and forward so that the position of the chair may be adjusted to a suitable position to the user.

14. The exercise assisting instrument defined in claim 1 wherein said chair has a structure able to tilt forward so that the user may easily stand up when some part of the user's body touches said chair to tilt forward.

15. The exercise assisting instrument defined in claim 12 wherein said stopper is a column member established under said chair and supports said chair at the upper part of said column member when said chair moves downward.

16. The exercise assisting instrument defined in claim 1 wherein said exercise assisting instrument further includes, an assisting force adjusting device that adjusts assisting forces of said upward movement of said chair according to the user's condition.

17. The exercise assisting instrument defined in claim 1 wherein said exercise assisting instrument further includes, a counter for counting a number of knee-bending movements of the user.

18. The exercise assisting instrument defined in claim 1 wherein said base has slip stoppers to prevent slipping so that the user does not slip.

* * * * *